United States Patent [19]

Bull

[11] Patent Number: 5,013,031

[45] Date of Patent: May 7, 1991

[54] EXERCISE APPARATUS

[76] Inventor: John W. Bull, 2505 Wedgewood Ct., Olympia, Wash. 98501

[21] Appl. No.: 583,543

[22] Filed: Sep. 17, 1990

Related U.S. Application Data

[63] Continuation-in-part of Ser. No. 512,299, Apr. 17, 1990, abandoned.

[51] Int. Cl.[5] ..... A63B 1/00

[52] U.S. Cl. ..... 272/70; 272/73

[58] Field of Search ..... 272/70, 71, 73, 96, 272/97, 69, 130, 72

[56] References Cited

U.S. PATENT DOCUMENTS

| | | | |
|---|---|---|---|
| 3,511,500 | 5/1970 | Dunn | 272/79 |
| 3,747,924 | 7/1973 | Champoux | 272/79 R |
| 3,759,511 | 9/1973 | Zinkin et al. | 272/58 |
| 3,970,302 | 7/1976 | McFee | 272/130 |
| 4,563,001 | 1/1986 | Terauds | 272/72 |
| 4,600,187 | 7/1986 | Schenker | 272/70 |
| 4,618,139 | 10/1986 | Haaheim | 272/70 |
| 4,708,338 | 11/1987 | Potts | 272/70 |
| 4,798,379 | 1/1989 | Jenkins | 272/70 |
| 4,830,362 | 5/1989 | Bull | 272/70 |
| 4,838,543 | 6/1989 | Armstrong et al. | 272/70 |
| 4,842,268 | 6/1989 | Jenkins | 272/73 |
| 4,934,690 | 6/1990 | Bull | 272/70 |

*Primary Examiner*—Stephen R. Crow
*Attorney, Agent, or Firm*—F. Eugene Logan

[57] ABSTRACT

An exercise apparatus which simulates stair climbing, is adjustable to achieve various levels of difficulty and adjustable to accommodate individuals of all heights. The exercise apparatus has a support structure, left and right foot levers pivotally connected to the support structure, a rotatable shaft rotatably attached to the support structure, and left and right clutches drivingly connected to the rotatable shaft. The left and right clutches independently drive the rotatable shaft in a drive-rotational direction when either of the clutches is rotated in the drive-rotational direction. Each clutch overrides the rotatable shaft when rotated in the counter drive-rotational direction. Pulleys or sprockets are mounted on each of the clutches. A rope or chain drivingly engages the pulleys or sprockets and causes their rotation when the foot levers are moved. A worm gear, which is driven by the rotatable shaft, is part of a resistance assembly mounted on the support structure. The resistance assembly contains a worm driven by the worm gear, a flywheel mounted on the worm, and braking device for braking the flywheel. The worm gear assembly and flywheel imparts a smooth, dynamic fluid-like operation to the movement of the foot levers. In one embodiment the foot levers operate independently of each other. In another embodiment the foot levers are synchronized. In still another embodiment the foot lever operation can be easily converted back and forth between independent and synchronized motion thereby allowing for variation in exercising routines.

24 Claims, 20 Drawing Sheets

EXERCISE APPARATUS

CROSS REFERENCES TO RELATED APPLICATIONS

This application is a continuation-in-part of Ser. No. 512,299 filed Apr. 17, 1990, now abandoned for an Exercising Apparatus.

BACKGROUND OF THE INVENTION

1. Field of the Invention

The present invention is concerned with exercise apparatus which simulates stair climbing. The exercise apparatus is adjustable to simulate various levels of difficulty and to accommodate individuals of all heights.

2. Discussion of the Invention

Walking, jogging, hiking and swimming are very popular forms of exercise usually and sometime always performed outside. Unfortunately as individuals become more occupied by their careers, families and other activities, they tend to spend less time exercising thereby lowering their general health and ability to resist various diseases and other ailments. Sometimes individual do not exercise because they do not want to be seen by others while exercising or they do not want to spend relatively large amounts for their own personal exercise facilities and equipment. Therefore there is a need for relatively inexpensive equipment that can be used in the privacy of the user's residence.

It is generally recognized that for exercise apparatus to be most beneficially to the human body and less likely to cause injury to the user, the exercise apparatus should exert a smooth, fluid-like force and motion on the user's body. Smooth, fluid-like force and motion is most difficult to achieve at the end of a cycle, i.e. at the change of direction of motion of the user's limbs as the exercise apparatus is being used.

Therefore with regard to equipment which simulates stair climbing, there is a need for exercise apparatus which provides a smooth, fluid-like force and motion.

SUMMARY OF THE INVENTION

It is an object of this invention to provide an exercise apparatus which simulates stair climbing and which tends to impart a smooth, fluid-like dynamic force and motion on the user's legs and body.

It is also an object of this invention to provide an exercise apparatus which is relatively inexpensive to construct, quiet in operation so that others are not disturbed by its usage, durable and only requires a relatively small space so that it can be easily stored or conveniently located in the user's residence.

Accordingly there is provided by the principles of this invention an exercise apparatus comprising a support structure; a left foot lever pivotally connected to the support structure; and a corresponding right foot lever pivotally connected to the support structure. The exercise apparatus further comprises a rotatable shaft, sometimes referred to as a first or input shaft, rotatably attached to the support structure, first clutch means drivingly connected to the rotatable shaft, the first clutch means for independently driving the rotatable shaft in a first-rotational direction when the first clutch means is rotated in the first-rotational direction and for overriding the rotatable shaft when the first clutch means is rotated in the counter first-rotational direction, and corresponding second clutch means drivingly connected to the rotatable shaft, the second clutch means for independently driving the rotatable shaft in the first-rotational direction when the second clutch means is rotated in the first-rotational direction and for overriding the rotatable shaft when the second clutch means is rotated in the counter first-rotational direction. The exercise apparatus further comprises a first engaging member drivingly connected to the first clutch means, and a corresponding second engaging member drivingly connected to the second clutch means. The exercise apparatus still further comprises first flexible linking means for drivingly engaging the first engaging member, and for causing rotation of the first engaging member when the left foot lever is moved, and second flexible linking means for drivingly engaging the second engaging member, and for causing rotation of the second engaging member when the right foot lever is moved.

The exercise apparatus also comprises a worm gear drivenly connected to the rotatable shaft, a worm drivenly geared to the worm gear, and, means for resisting the rotation of the worm. In a further embodiment the worm gear is mounted on the rotatable shaft and the worm engages the worm gear. Back driving a worm gear assembly provides a smooth, fluid-like force and motion to operative elements such as foot levers.

In one embodiment of this invention the exercise apparatus comprises first biasing means for maintaining an upward bias on the left foot lever, and, second biasing means for maintaining an upward bias on the right foot lever. In this embodiment the left foot lever and the right foot levers are not necessarily synchronized. In another embodiment the exercise apparatus further comprises converting means for converting from independent foot lever operation to synchronized foot lever operation. In still another embodiment the exercise apparatus comprises first tensioning means for maintaining the first flexible linking means in tension, and, second tensioning means for maintaining the second flexible linking means in tension.

In another embodiment of this invention the exercise apparatus comprises synchronization means for synchronizing the movement of the left and right foot levers. In this embodiment the first flexible linking means and the second flexible linking means are connected. In one embodiment the distal ends of the first and second flexible linking means near the distal ends of the first and second tensioning means, respectively, are connected by a user connected third flexible linking means.

In another embodiment of this invention which comprises a synchronization means, the first and second tensioning means are not required. The synchronization means comprises a flexible linking means for providing a tension connection between the left foot lever and the right foot lever, for drivingly engaging the first engaging member and the second engaging member, and for causing rotation of the first engaging member and the second engaging member when the foot levers are moved. In this embodiment the synchronization means causes upward movement of one foot lever when the other foot lever is moved downward.

In one embodiment of this invention the exercise apparatus further comprises a flywheel drivenly connected to the rotatable shaft and rotatably mounted on the support structure, and, resistance means for resisting the rotation of the flywheel. The size and mass of the flywheel should be sufficient that it provides a substantial amount of momentum as the exercise apparatus is being used. The momentum of the flywheel enables a smooth, fluid-like force and motion on the user's body as the exercise apparatus is being used. The coupling of a worm gear assembly with a flywheel driven by the worm can further improve the smooth, fluid-like dynamic force and motion on the user's body.

In another embodiment of this invention the resistance means includes a worm gear mounted on the rotatable shaft, a worm drivenly geared to the worm gear, a flywheel mounted on the worm, and braking means for braking the flywheel. In a further embodiment the resistance means is supported by the support structure.

In one embodiment of this invention which comprises a flywheel, the flywheel is rigidly secured to the rotatable shaft. In another embodiment the exercise apparatus further comprises a third engaging member drivenly mounted on the rotatable shaft, a second flexible linking means drivenly connected to the third engaging member and drivingly connected to the flywheel. In yet another embodiment the exercise apparatus further comprises a rotatable output shaft drivenly connected to the first or input rotatable shaft, and, the flywheel is drivenly connected to the rotatable output shaft. In still another embodiment the exercise apparatus further comprising a third engaging member drivenly mounted on the rotatable shaft, a second flexible linking means drivenly connected to the third engaging member and drivingly connected to a second rotatable member which is rotatably attached to the support structure, and the flywheel is drivenly connected to the second rotatable member. In a further embodiment the rotatable member is a shaft.

In one embodiment of this invention the resistance means includes a brake. In a further embodiment the brake is adjustable. In another embodiment the brake is a frictional brake. Non-limiting examples of frictional brakes useful in this invention are band or pony brakes and caliper brakes.

In one embodiment of this invention the support structure includes an upstanding member and a base, and the foot levers are pivotally connected to a buttress member which is rigidly secured to the upstanding member. In another embodiment the first or input rotatable shaft is rotatably attached to the upstanding member. In still another embodiment the resistance means is supported by the upstanding member.

In another embodiment of this invention the first or input rotatable shaft is traversely oriented with respect to the foot levers. In a further embodiment the first and second clutch means become left and right clutch means, respectively, and the first and second engaging members become left and right engaging members, respectively.

In one embodiment of this invention the first and second clutch means are drivingly connected to the rotatable shaft by being mounted on the rotatable shaft. In one embodiment the first and second engaging members are mounted on the first and second clutch means, respectively. In another embodiment the first engaging member and the second engaging member are pulleys. In a further embodiment the pulleys are mounted on the first and second clutch means. In another embodiment the first and second engaging members are sprockets. In a further embodiment the sprockets are mounted on the first and second clutch means.

In one embodiment of this invention the flexible linking means is a cable. In another embodiment the flexible linking means is a belt. In still another embodiment the flexible linking means is a chain. In yet another embodiment of this invention the flexible linking means is a rope.

In one embodiment of this invention the synchronization means includes reversal means attached to the support structure for reversing the direction of the flexible linking means. In a further embodiment the reversal means is rotatably attached to the support structure.

DESCRIPTION OF THE PREFERRED EMBODIMENTS

Figure 1:
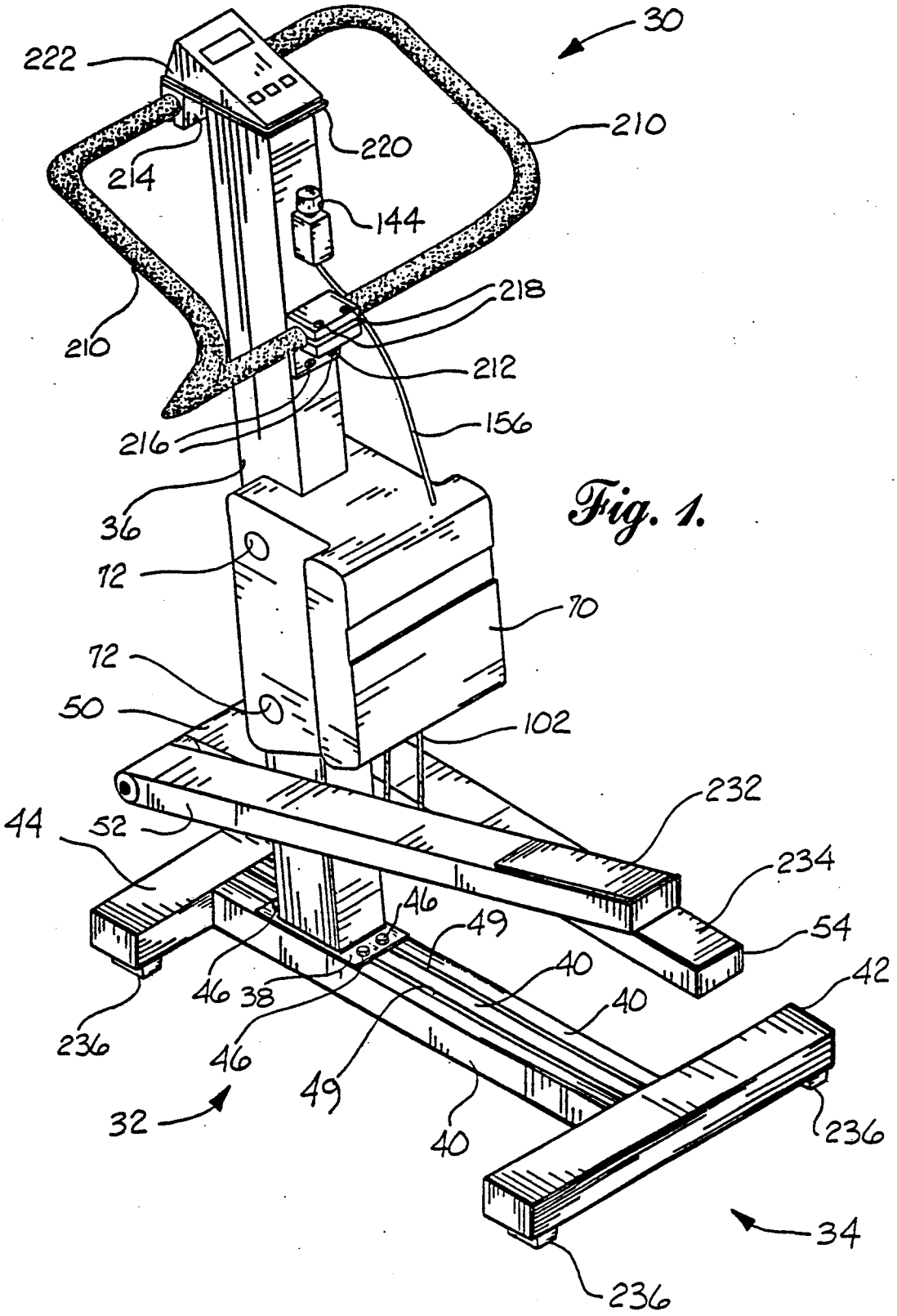
FIG. 1 is a top, front and left side perspective view of the exercise apparatus of this invention.

Referring to the drawings, and in particular to FIGS. 1 to 4, a preferred embodiment of the exercise apparatus of this invention, generally designated by reference numeral 30, is shown. The exercise apparatus comprises a support structure 32 having base frame 34 which rest upon the floor and upstanding member 36 having plate 38 welded to the bottom thereof. Base frame 34 is H-shaped with three spaced apart parallel longitudinal members 40 welded to front and rear traverse members 42 and 44. Plate 38 of upstanding member 36 is rigidly secured to longitudinal members 40 by bolts 46 which pass through plate 38 and longitudinal slots 49 and then are secured with nuts 48. Buttress member 50 is secured to upstanding member 36 by welding. Pivotally mounted with respect to buttress member 50 are left and right foot levers 52 and 54.

Figures 5, 6:
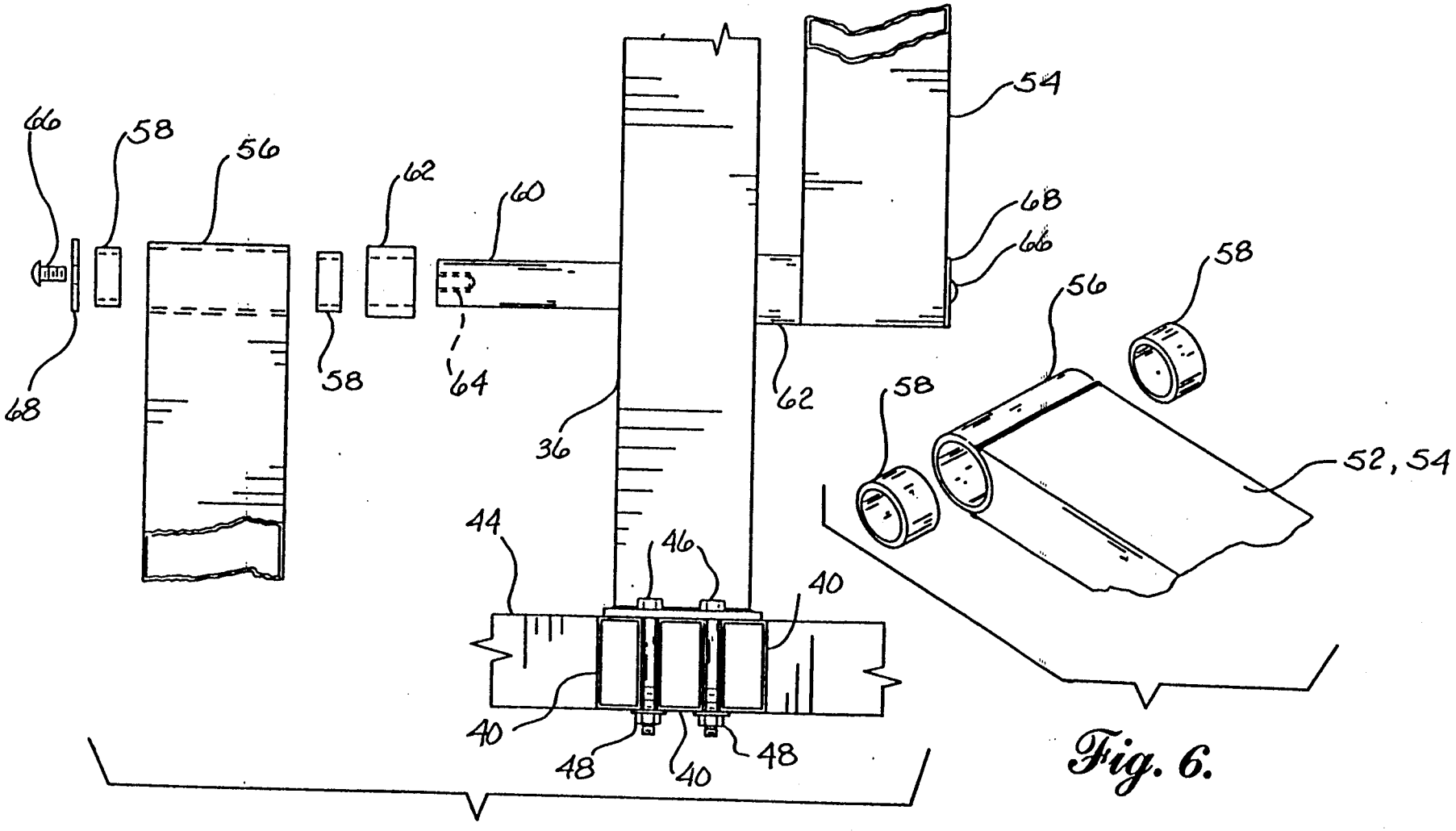
FIG. 5 is a front elevational view of the foot lever section of the exercise apparatus of FIG. 3 with the components of the left side exploded.
FIG. 6 is a perspective view of the rear portion of a foot lever with its components exploded.

FIGS. 5 and 6 show the details of the pivotal mounting of foot levers 52 and 54 to upstanding member 36. In particular foot levers 52 and 54 to upstanding member 36. In particular FIG. 5 shows an exploded view of the assembly of components of left foot lever 52 on to shaft 60. Right foot lever 54 is shown mounted on the right side of the exercise apparatus. FIG. 6 shows an exploded view of the components for forming the pivotal end of foot levers 52 and 54, which are shown to consist of an annular sleeve 56 welded to the distal ends of foot levers 52 and 54, and sintered bronze bearings 58 press fitted into each end of annular sleeve 56. Cylindrical shaft 60 extends through buttress member 50 and is rigidly secured thereto by welding. Buttress member 50 is rigidly secured to upstanding member 36 by welding. Annular spacers 62 are slideably mounted on opposite sides of shaft 60 and abut against buttress member 50. The ends of shaft 60 contain internally threaded bores 64. Corresponding externally threaded fasteners 66, and washers 68, are used to secure foot levers 52 and 54 to the left and right sides, respectively, of shaft 60. In particular, spacers 62 are first slid over shaft 60 from the left and right sides. Then foot lever assemblies 52 and 54, having annular sleeve 56 with bearings 58 pre-installed, are slid over shaft 60 and abutted against spacers 62. Lastly fasteners 66, with washers 68, are screwed into bores 64 thereby securing the foot levers in a pivotal relationship to upstanding member 36.

Figure 7:
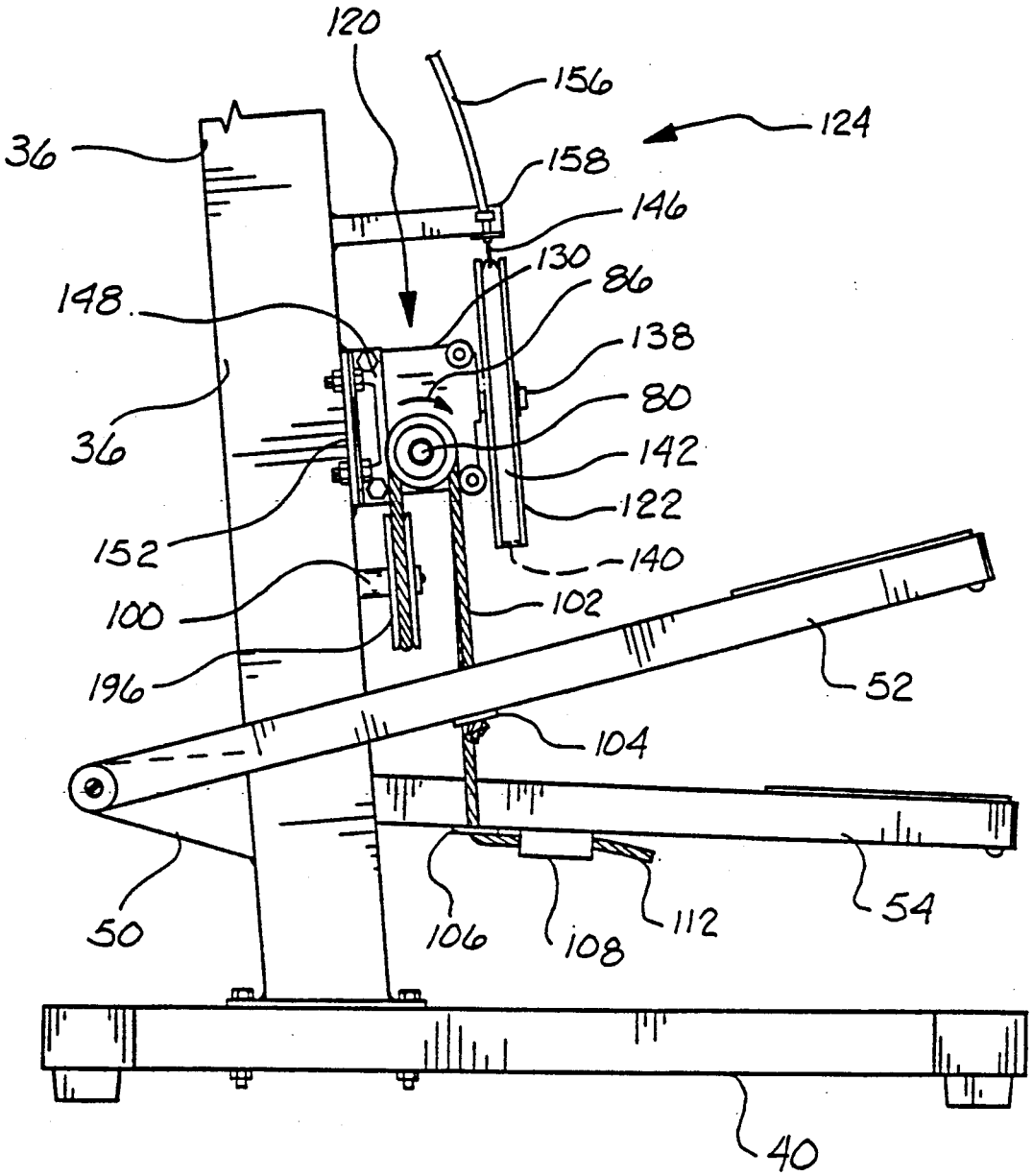
FIG. 7 is a left side elevational view of the lower half of the exercise apparatus of FIG. 2 with the cover removed.
Figure 8:
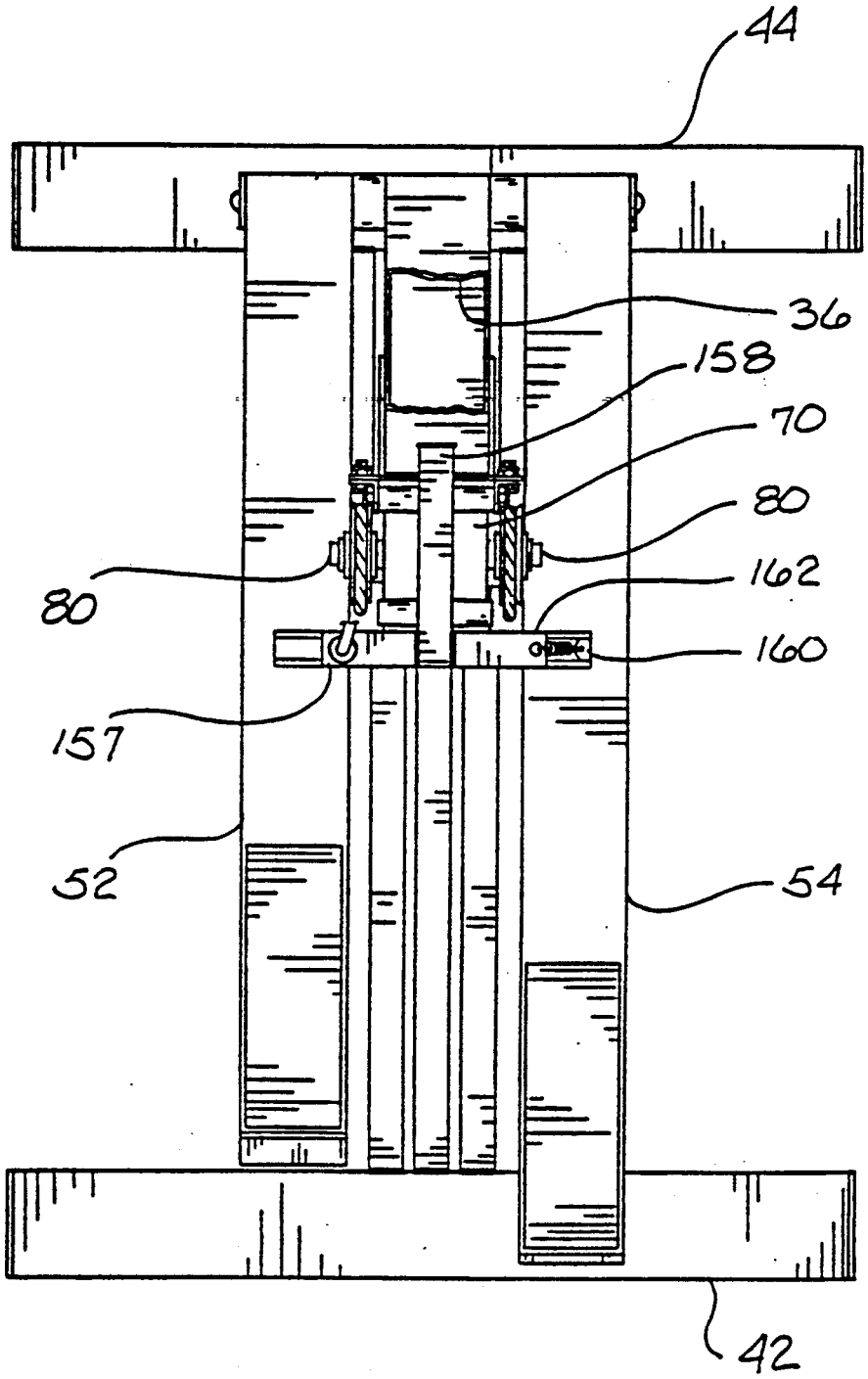
FIG. 8 is a top plan view of the exercise apparatus of FIG. 4 with the cover removed.
Figure 9:
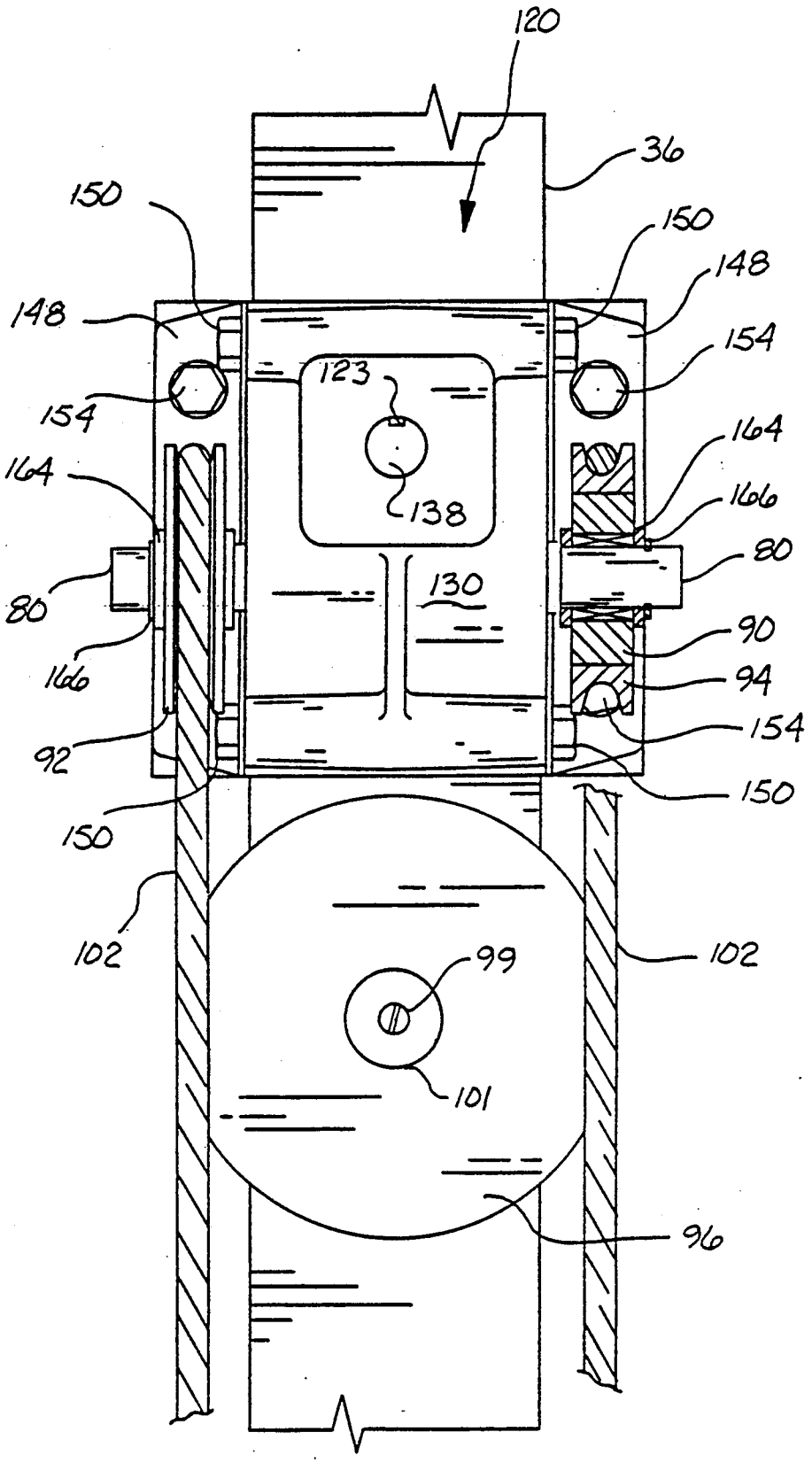
FIG. 9 is an enlarged front view of FIG. 7 with right pulley in cross section showing additional details of the exercise apparatus.
Figure 10:
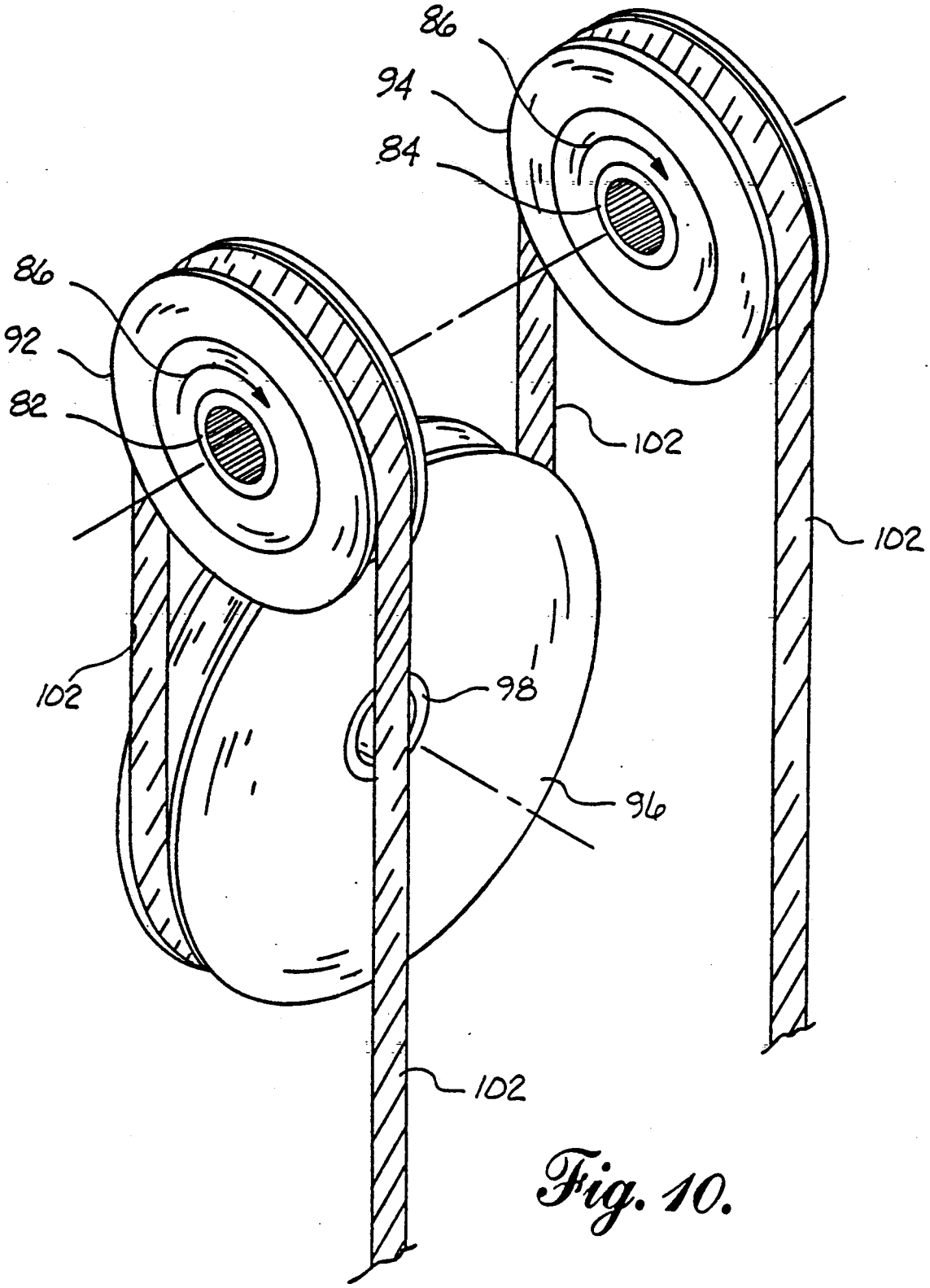
FIG. 10 is a perspective view of the left and right pulleys and rope of FIG. 9.
Figure 11:
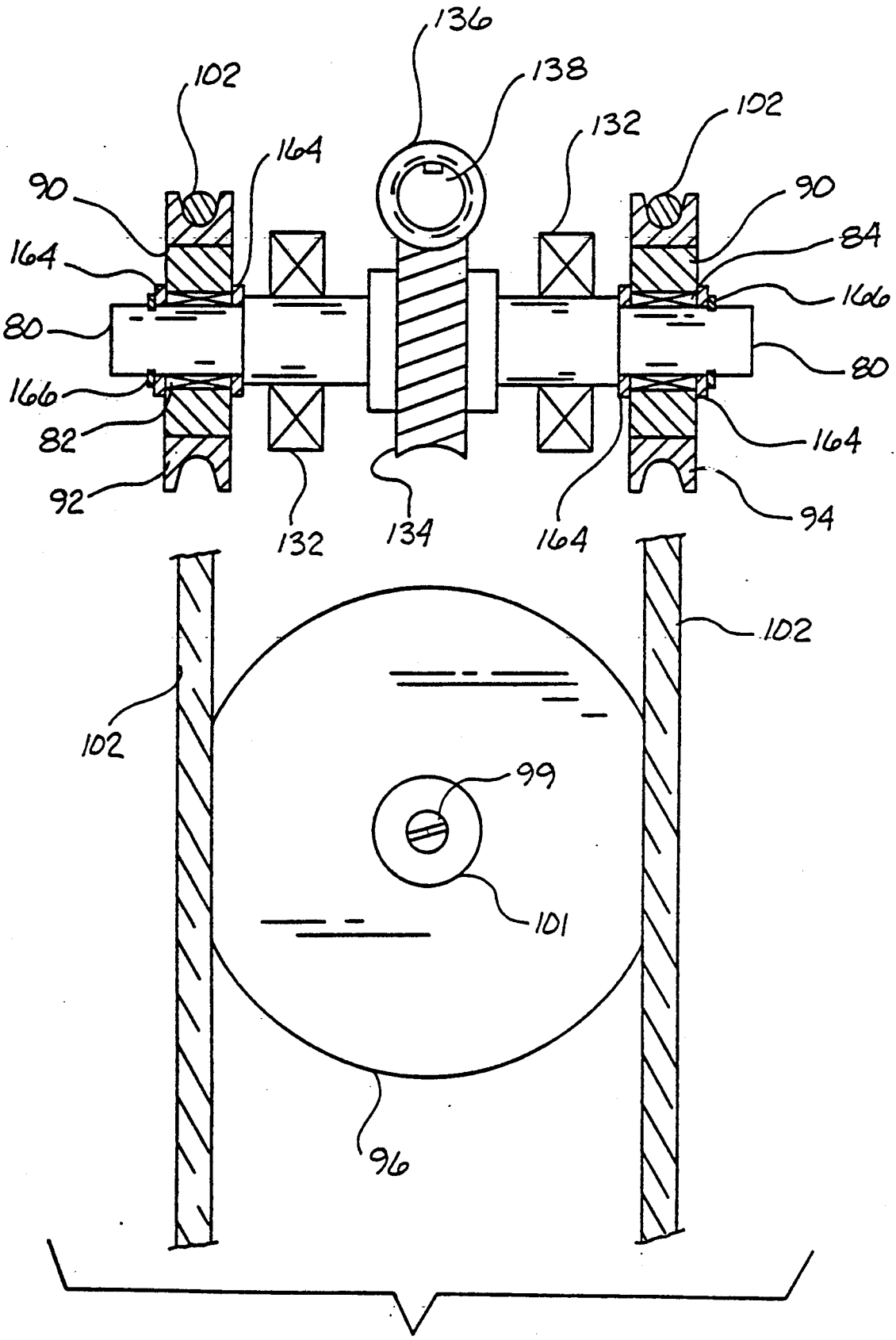
FIG. 11 is a front view of FIG. 9 with the transmission housing removed to show details of the worm gear transmission.

A synchronization means for causing upward movement of one foot lever when the other foot lever is moved downward is largely obscured from view by cover 70 in FIGS. 1 to 4. Cover 70 is secured to upstanding member 36 by fasteners 72. Cover 70 is removed in FIGS. 7 to 11 to shown the details of the synchronization means. FIGS. 7 and 8 correspond to FIGS. 2 and 4, but with cover 70 removed to show details of the synchronization means. Referring also to FIGS. 9 to 11, synchronization means comprises traversely oriented rotatable shaft 80, and roller clutches, 82 and 84, which are mounted on the left and right sides, respectively, of rotatable shaft 80. When either roller clutch is rotated in a drive-rotational direction, represented by arrow 86, the roller clutch will drive rotatable shaft 80. However, when either roller clutch is rotated in the opposite direction to arrow 86, i.e. the counter drive-rotational direction, the roller clutch will override rotatable shaft 80. Non-limiting example of suitable roller clutch are Torrington model no. RC-101410 roller clutches. Each roller clutch can independently drive rotatable shaft 80. Press fitted on to each roller clutch are hubs 90 which are preferably made from a light weight material such as aluminum. Vulcanized on to each hubs 90 are annular pulleys 92 and 94 preferably made from a material having a high coefficient of friction such as polyurethane. Idler pulley 96 having a sintered bronze bushing 98 is rotatably mounted on shaft 100. Shaft 100 is positioned below and perpendicular to rotatable shaft 80 and is rigidly secured to upstanding member 36 by welding. Shaft 100 contains an internally threaded bore, similar to bores 64 of shaft 60. Corresponding externally threaded fastener 99 and washer 101 secure idler pulley 96 to shaft 100.

One end of rope 102 is knotted and threaded through an aperture in cleat 104 which rigidly secured to left foot lever 52 by welding. Rope 102 is then threaded up and over left pulley 92 in the counter drive-rotational direction, then threaded down and around idler pulley 96, then threaded up and over right pulley 94 in the drive-rotational direction, then threaded downward and through an aperture in cleat 106, and then threaded through fastening cleat 108. Cleat 106 is rigidly secured to right foot lever 54 by welding. Fastening cleat 108 is rigidly secured to right foot lever 54 by fasteners. Idler pulley 96 provides reversal means rotatably attached to the support structure for reversing the direction of rope 102 or other alternative flexible linking means.

Figure 2:
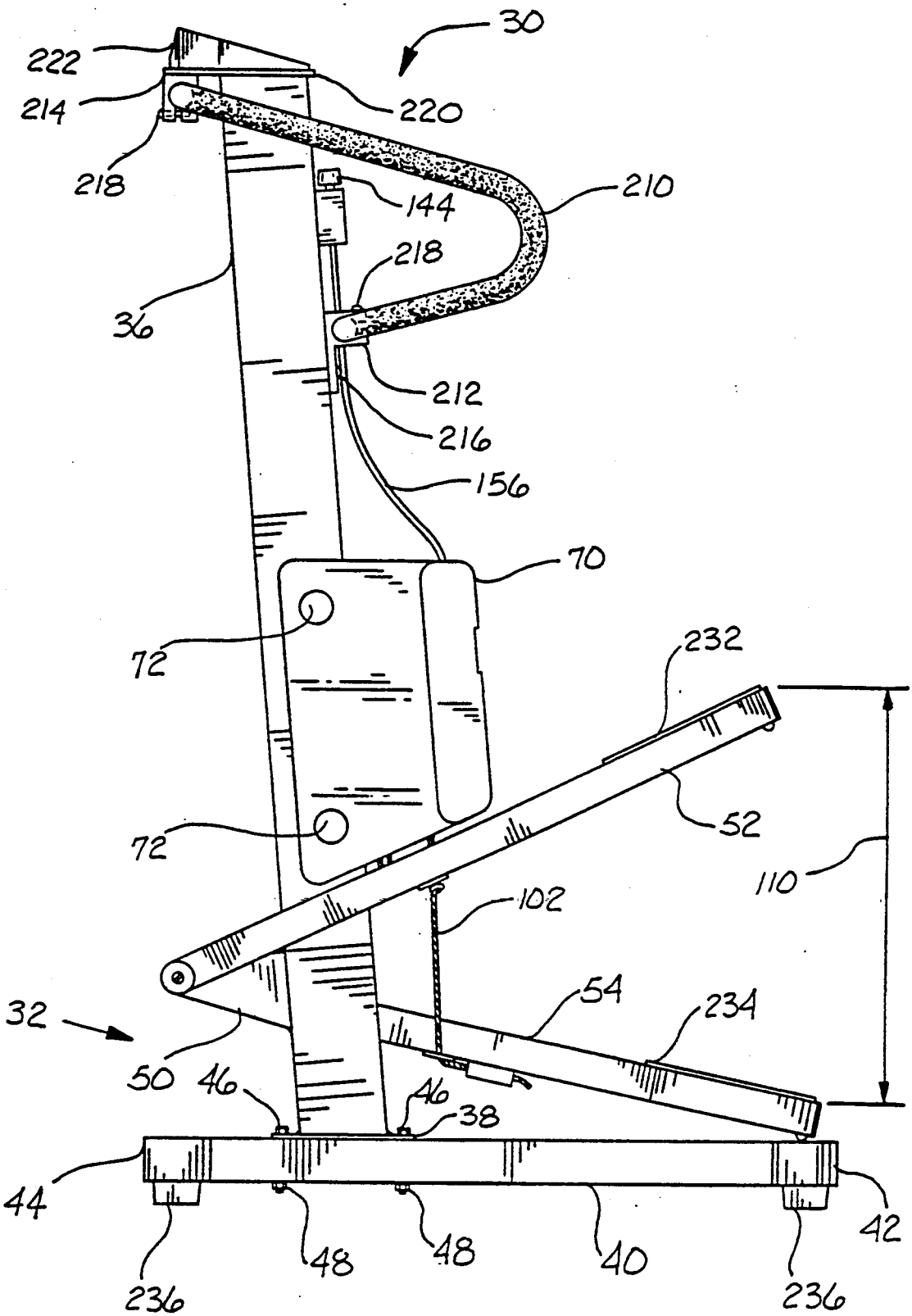
FIG. 2 is a left side elevational view of the exercise apparatus of FIG. 1.
Figure 3:
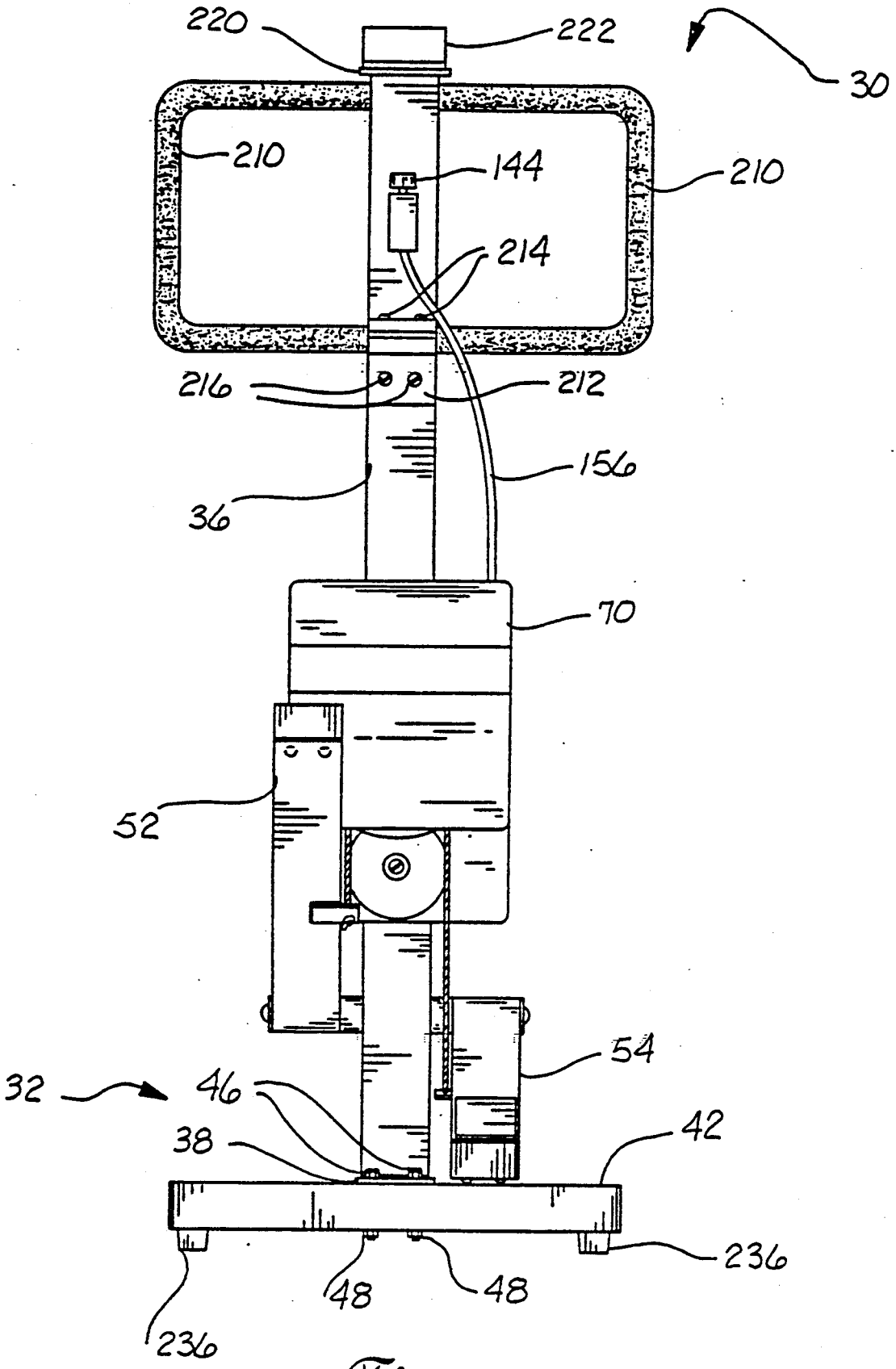
FIG. 3 is a front elevational view of the exercise apparatus of FIG. 1.
Figure 4:
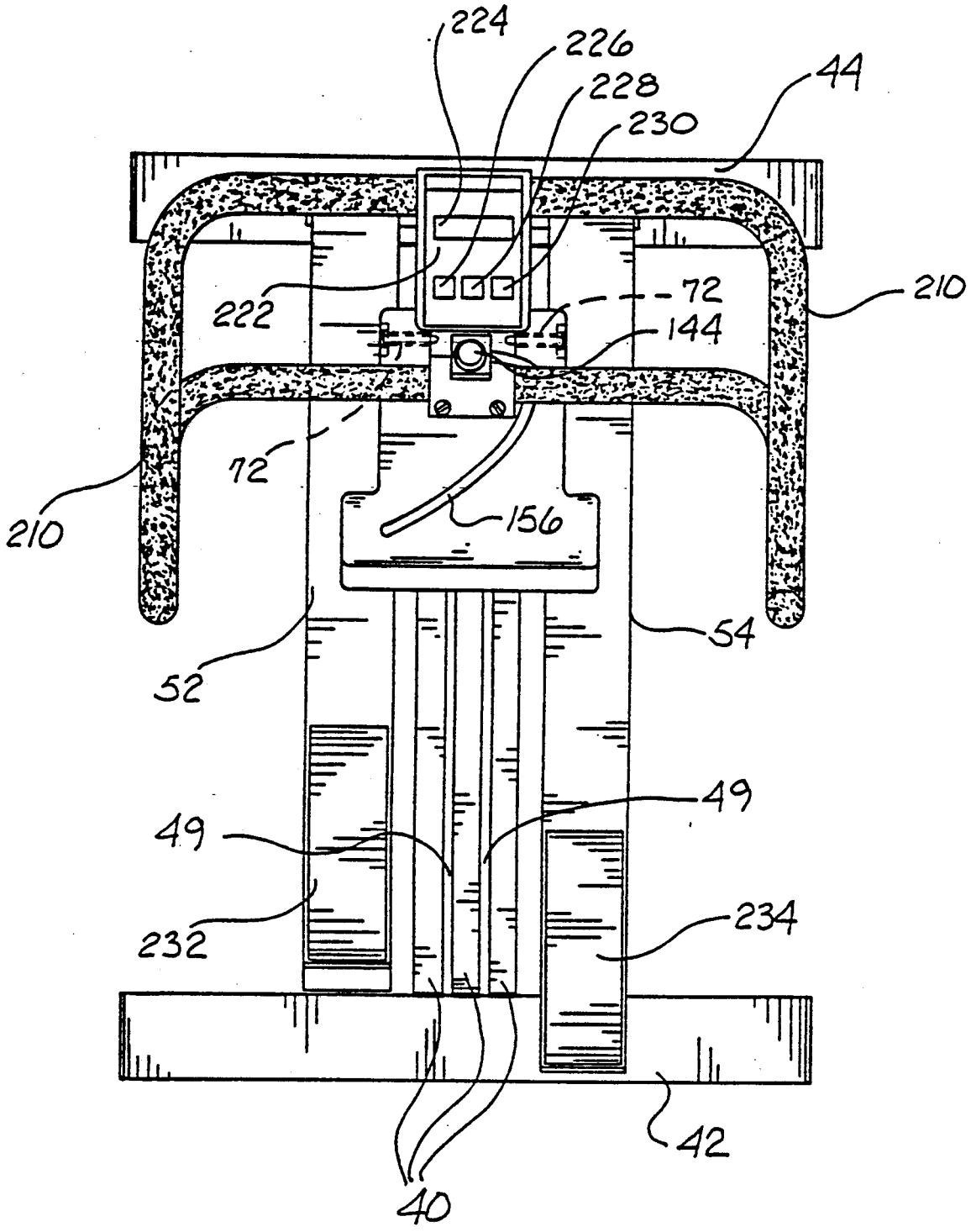
FIG. 4 is a top plan view of the exercise apparatus of FIG. 1.

The step height 110 is adjusted by depressing both foot levers to their furthermost downward positions. While holding right foot lever 54 down against front traverse member 42, end 112 of rope 102 is pulled taut until left foot lever 52 is elevated to the desired elevation, for example as shown in FIG. 2. Fastening cleat 108 is then tighten against rope 102 thereby setting the step height 110 of the exercise apparatus. To change step height 110, fastening cleat 108 is loosened and left foot lever 52 moved to the new desired step height, and, fastening cleat 108 is then re-tightened.

It can be seen that left pulley 92 and left hub 90 provide a left engaging member dirvingly connected to the left clutch 82, and that right pulley 94 and right hub 90 provide a right engaging member drivingly connected to the right clutch 84. It can also be seen that rope 102 provides flexible linking means for a tension connection between the left foot lever and the right foot lever, for drivingly engaging the left engaging member or left pulley 92 and the right engaging member or right pulley 94, and for causing rotation of the left engaging member and the right engaging member when the foot levers are moved.

The exercise apparatus preferably includes resistance means supported by the support structure, for resisting the rotation of the rotatable shaft 80. In embodiment 30 the resistance system comprises a worm gear system 120, a flywheel 122, and braking system 124 as shown in FIGS. 7, 8, 9 and 11. In embodiment 30 the worm gear system 120 comprises housing 130 in which rotatable shaft 80 is mounted between bearings 132. A worm gear 134 mounted on rotatable shaft 80 is driven by rotatable shaft 80. Worm gear 134 dirves worm 136, which is extended to form a worm shaft 138 on which is mounted flywheel 122. A conventional key is inserted between flywheel 122 and key slot 123 in shaft 138 to cause flywheel 122 to rotate with shaft 138.

Flywheel 122 has a recess 140 for receiving band 142 of braking system 124. Band 142 is tighten against flywheel 122 by turning knob 144 which pulls brake cable 146 up thereby pulling the left end of band 142 against the surface of recess 140 of flywheel 122. The resistance to rotation of rotatable shaft 80 can be controlled to the desired degree by the user merely by turning knob 144.

Housing 130 is rigidly secured to brackets 148 with bolts 150. Brackets 148 are rigidly secured to mounting plate 152 by bolts 154. A non-limiting example of a worm gear system suitable for this exercise apparatus is Morse Worm Gear Model 13ED which has a 7.5 to 1 gear reduction ratio. As seen in FIGS. 9 and 11, worm gear system 120 is used as a speed increaser. A resistance system using a worm gear system to back drive a flywheel in this manner provides a smooth non-jerky resistance to rotation of rotatable shaft 80. Furthermore the resistance to rotation of rotatable shaft 80 can be easily controlled and adjusted by turning control knob 144 which can be done while the user is using the exercise apparatus.

Brake cable 146 is housed in cable tube 156, the lower end of which, near flywheel 122, is rigidly secured to the left side 157 of T-post 158. T-post 158 is welded to upstanding member 36. The right end 160 of band 142 is connected to the right side 162 of T-post 158. Pulleys 92 and 94 are secured axially on rotatable shaft 80 by thrust washers 164, and, outer washers 164 are secured axially by split snap rings 166.

Figures 12, 13:
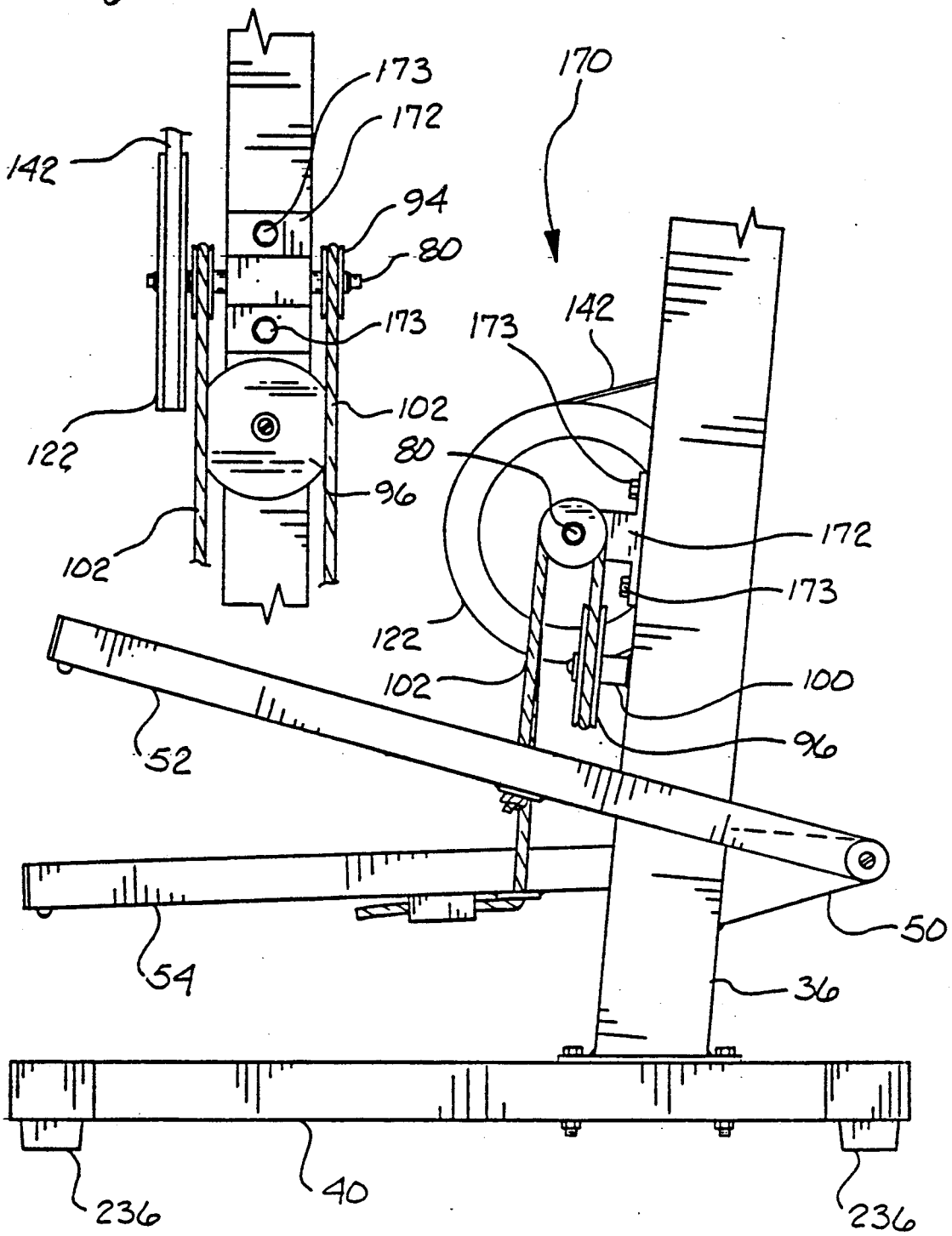
FIG. 12 is a right side elevational view of the bottom half of another embodiment of this invention showing a flywheel mounted directly on the rotatable shaft.
FIG. 13 is a front view of a detail of the pulley section of FIG. 12.
Figure 14:
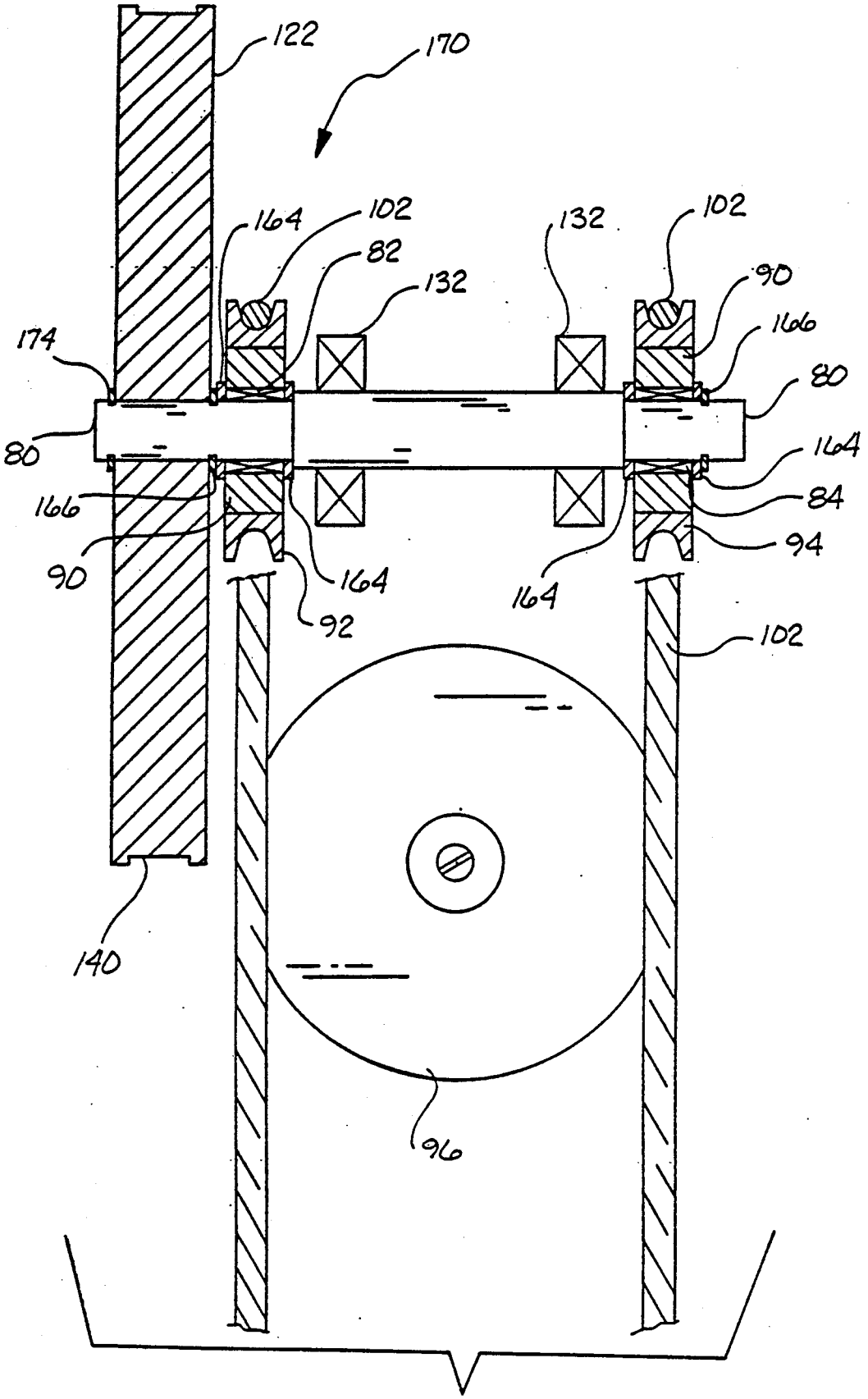
FIG. 14 is an enlarged view of the detail of FIG. 13 in cross section.

A simpler embodiment of a resistance system of this invention, generally designated by reference numeral 170, is depicted in FIGS. 12 to 14. Rotatable shaft 80 is rotatably mounted between bearings 132 which are supported by bearing block 172 which is rigidly secured to upstanding member 36 by bolts 173. The left side of rotatable shaft 80 is extended to allow flywheel 122 to be mounted thereon. Split snap ring 174 secures flywheel 122 axially on rotatable shaft 80. A braking system similar in principle to braking system 124 is used to resist rotation of rotatable shaft 80.

Figures 15, 16:
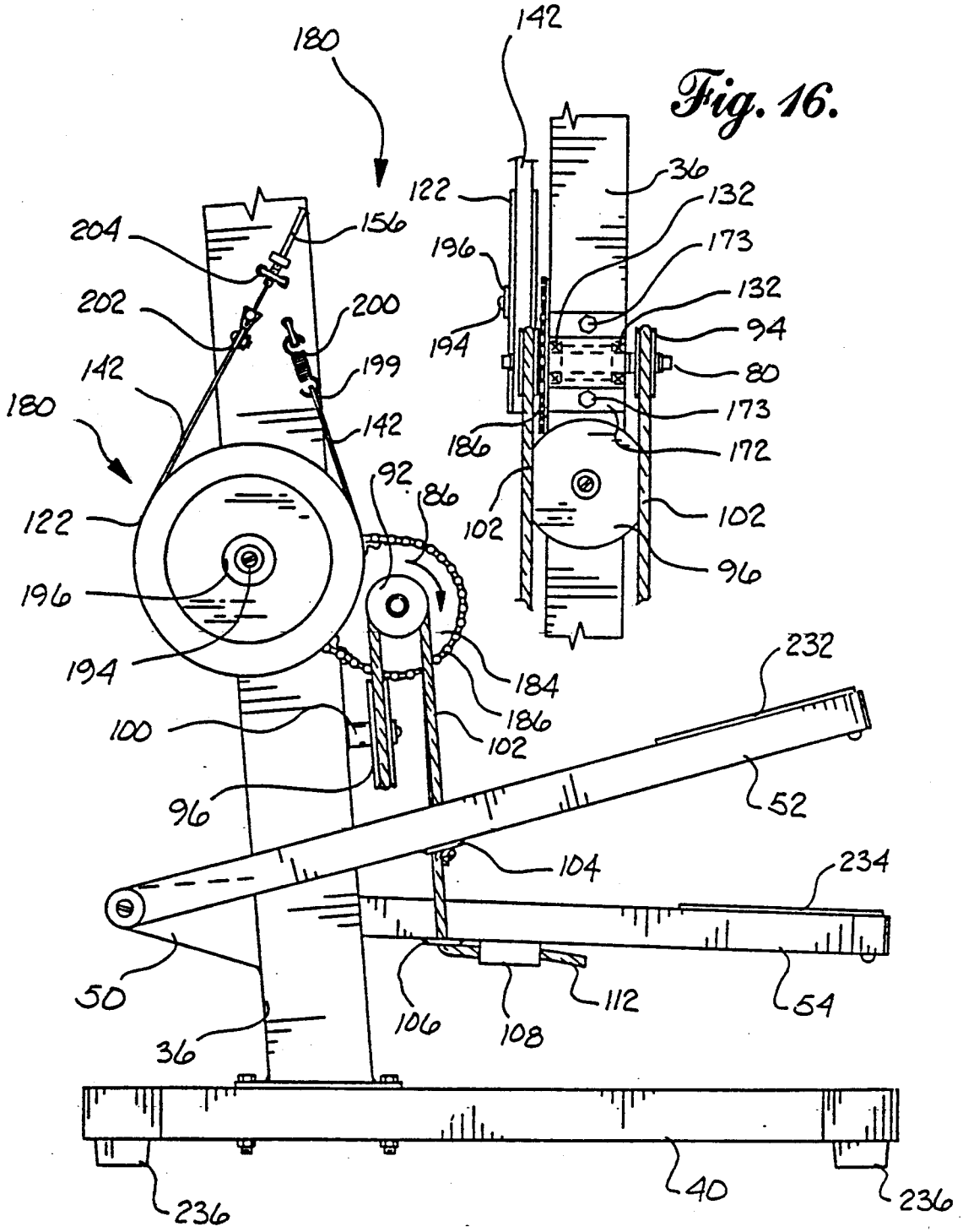
FIG. 15 is a left side elevational view, similar to FIG. 7, of a third embodiment of this invention showing a flywheel mounted on a second rotatable shaft which is driven by sprockets and chain system from the main rotatable shaft.
FIG. 16 is a front elevational view of a detail of FIG. 15.
Figure 17:
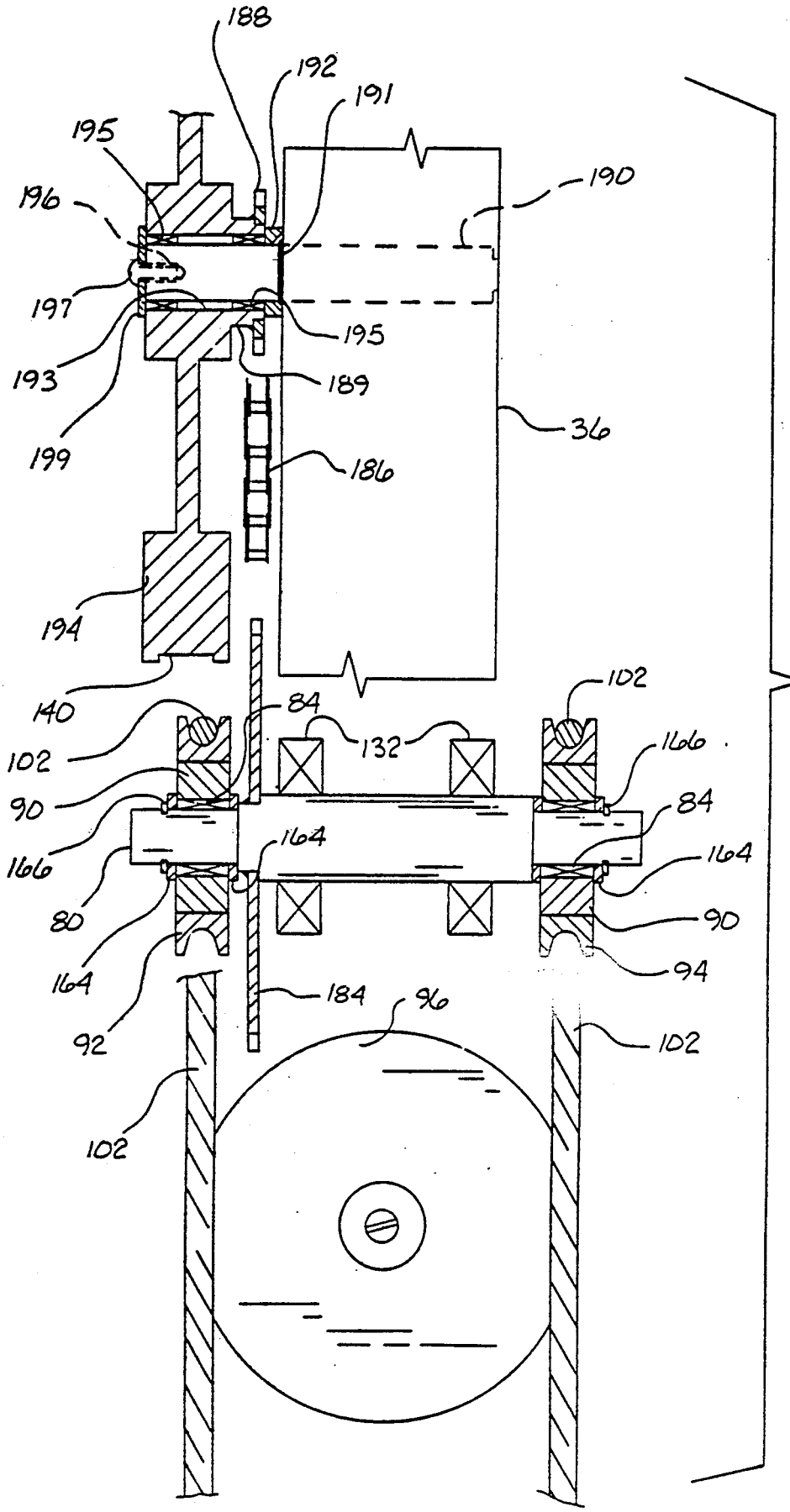
FIG. 17 is a enlarged front elevational view of the flywheel and pulleys of FIG. 16.

Another embodiment of a resistance system of this invention, generally designated by reference numeral 180, is shown in FIGS. 15 to 17. In this embodiment rotatable shaft 80 is rotatably mounted between bearings 132 of bearing block 172 which is rigidly secured to upstanding member 36 by bolts 173. A sprocket 184 is rigidly secured to rotatable shaft 80 by welding. Sprocket 184 drives continuous chain 186 which drives smaller diameter sprocket 188 which is welded to flywheel hub 189. Shaft 190 is rigidly secured to upstanding member 36 by weld 191. Spacer 192 containing a recess for weld 191 prevents chain 186 from rubbing against upstanding member 36. Press fitted into bore 193 of flywheel 194 are sintered bronze bearings 195. Flywheel 194 containing bearings 195 is mounted on cantilevered end of shaft 190. The cantilevered end of shaft 190 contains internally threaded bore 196. Corresponding externally threaded fastener 197 and washer 198 secure flywheel 194 to shaft 190.

A braking system similar to that of embodiment 30 and 170 is used in embodiment 180 with one end 199 of band 142 connected to spring 200 which is connected to upstanding member 36. The other end 202 of band 142 is connected to brake cable 146. Brake cable 146 is housed in cable tubing 156 the lower end of which is rigidly secured to post 204 which is welded to upstanding member 36. A similar braking system is used in embodiment 170.

Figure 18:
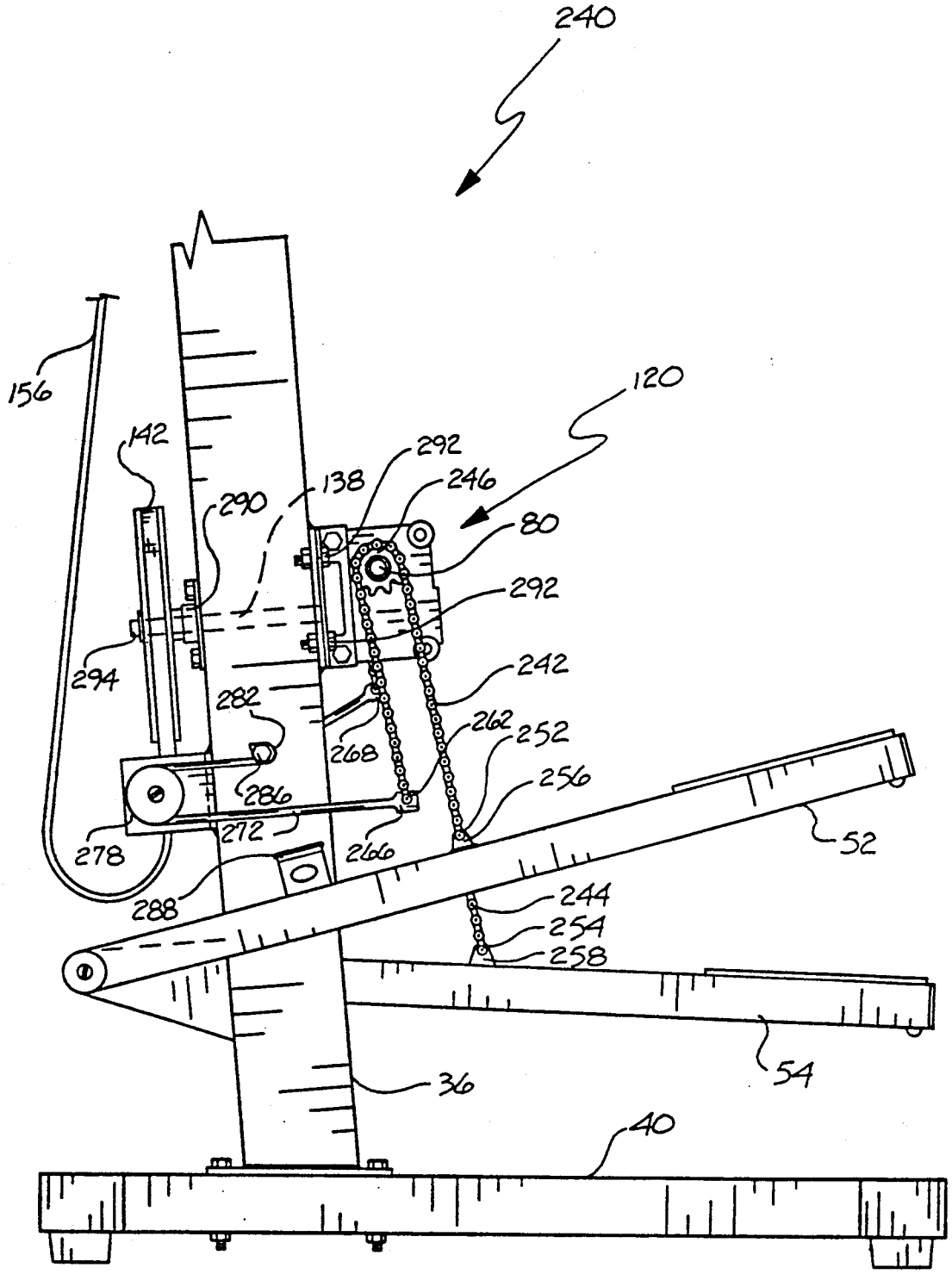
FIG. 18 is a left side elevational view of the lower half of a fourth embodiment of the exercise apparatus of this invention with independently operate foot levers.
Figure 19:
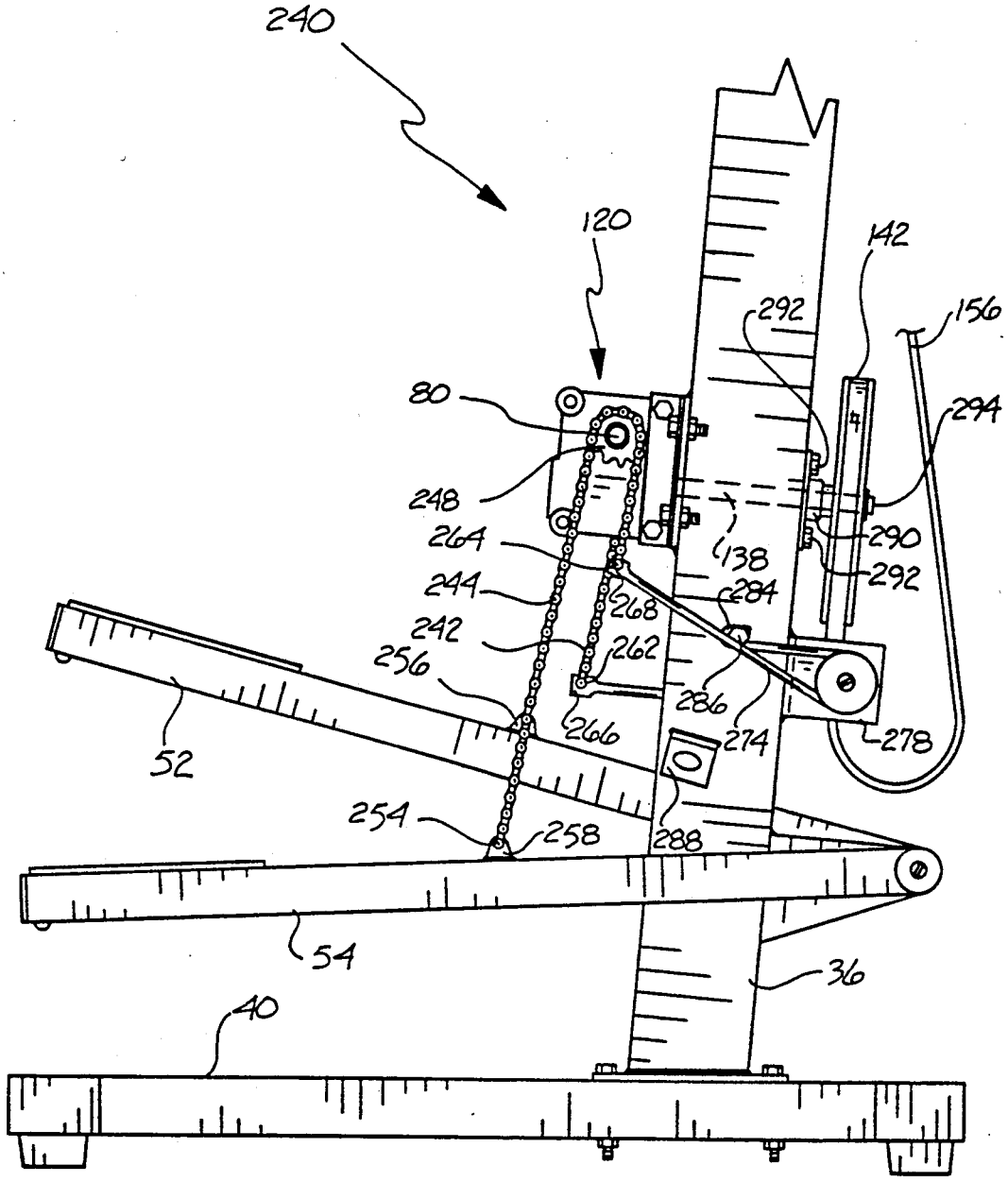
FIG. 19 is a right side elevational view of the embodiment of FIG. 18.
Figure 20:
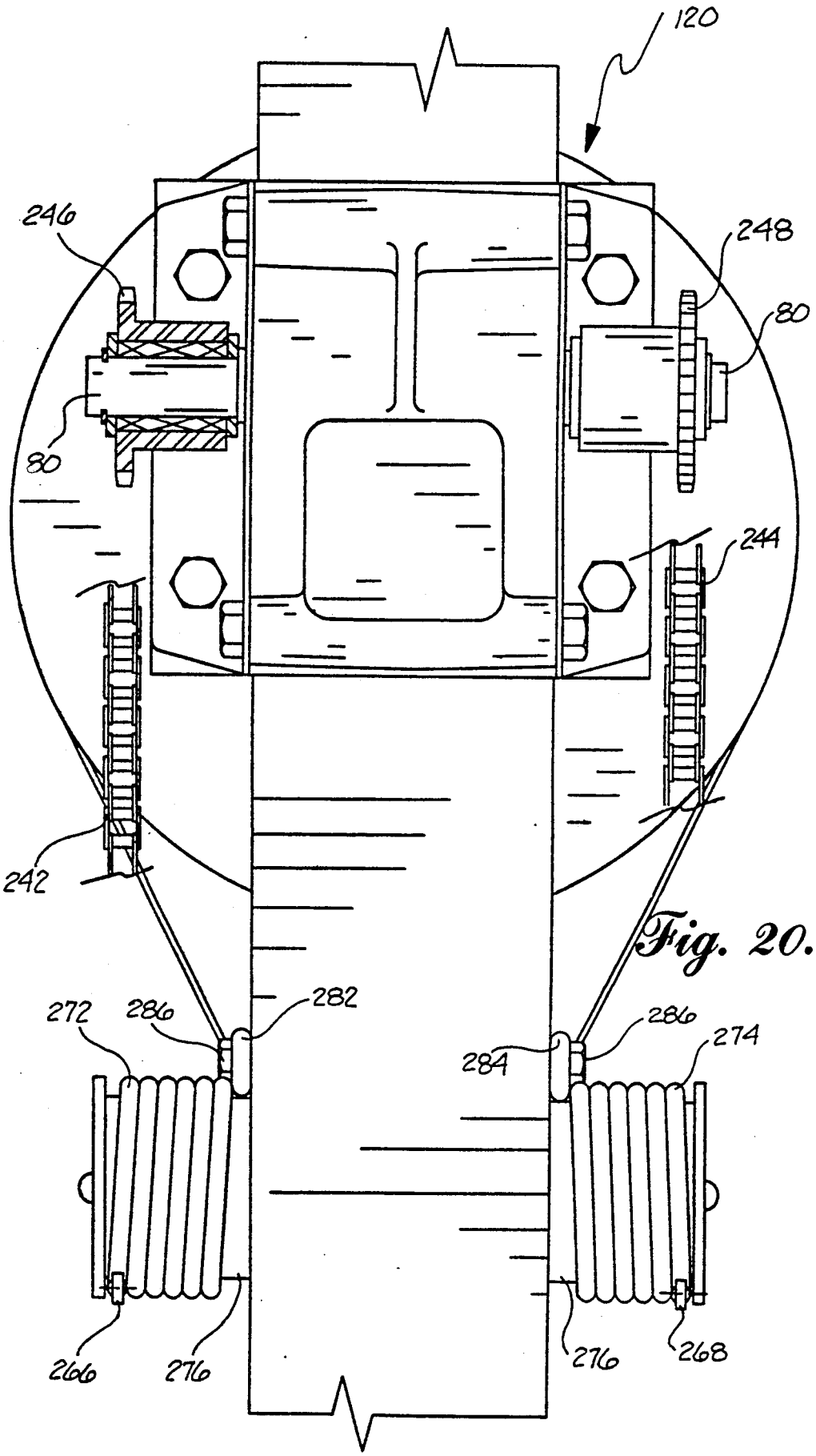
FIG. 20 is an enlarged front view of the embodiment of FIG. 18.

Still another embodiment of this invention, generally designated by numeral 240, is shown in FIGS. 18 to 20. In this embodiment the foot levers operate independently. Left and right chains 242 and 244 provide flexible linking means drivenly engaging left and right sprockets 246 and 248, respectively, which are in turn mounted on roller clutches, 82 and 84, respectively. Roller clutches, 82 and 84 are mounted on left and right sides of rotatable input shaft 80 of worm gear system 120 and function in the same manner as in earlier described embodiments. Distal ends 252 and 254 of chains 242 and 244, respectively, are pivotally connected to left and right brackets 256 and 258, respectively, which are in secured to foot levers 52 and 54, respectively, as by welding. The other distal ends 262 and 264 of chains 242 and 244, respectively, are connected to distal ends 266 and 268, respectively, of torsion springs 272 and 274, respectively, which are pivotally mounted on shaft 276. Shaft 276 is secured to bracket 278 which is secured to upstanding member 36. The other distal ends 282 and 284 of torsion springs 272 and 274, respectively, are secured to upstanding member 36 by bolts 286. Since torsion springs 272 and 274 provide means for upward biasing of foot levers 52 and 54, respectively, rubber padded bumper brackets 288 are welded to each side of upstanding member 36 to prevent the foot levers from rotating past a predetermined maximum height.

Figure 21:
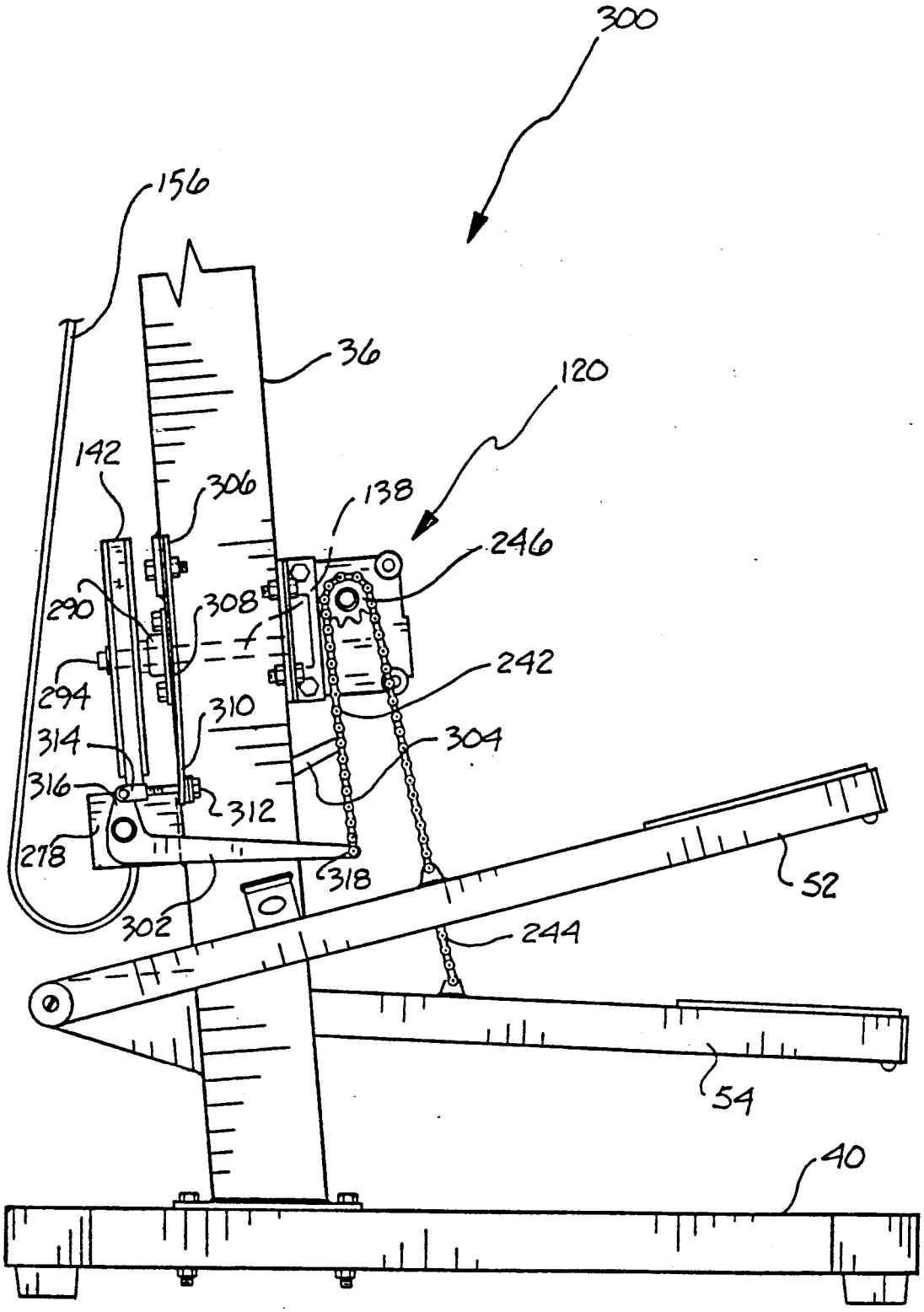
FIG. 21 is a left side elevational view of the lower half of a fifth embodiment of the exercise apparatus of this invention with independently operated foot levers.

In another embodiment of this invention shown in FIG. 21 and generally designated by numeral 300, the means for maintaining an upward bias on the foot levers comprises left and right leaf springs connected to pivotally mounted left and right cams 302 and 304. Top end 306 of left leaf spring 308 is rigidly secured to upstanding member 36. Bottom end 310 of left leaf spring 308 is connected to bolt 312 which is connected to yoke connector 314 which is pivotally connected to top distal end 316 of left cam 302. Cams 302 and 304 are pivotally mounted on bracket 278. Front distal end 318 of left cam 302 is connected to one end of left chain 242. Right cam 304 is similarly connected to a right leaf spring (hidden from view in FIG. 21) and right chain 244 and similarly pivotally mounted to the right side of bracket 278 thereby providing means for maintaining an upward bias on right foot lever 54. The left and right leaf springs also provide means for maintaining left and right chains 242 and 244 in tension.

Figure 22:
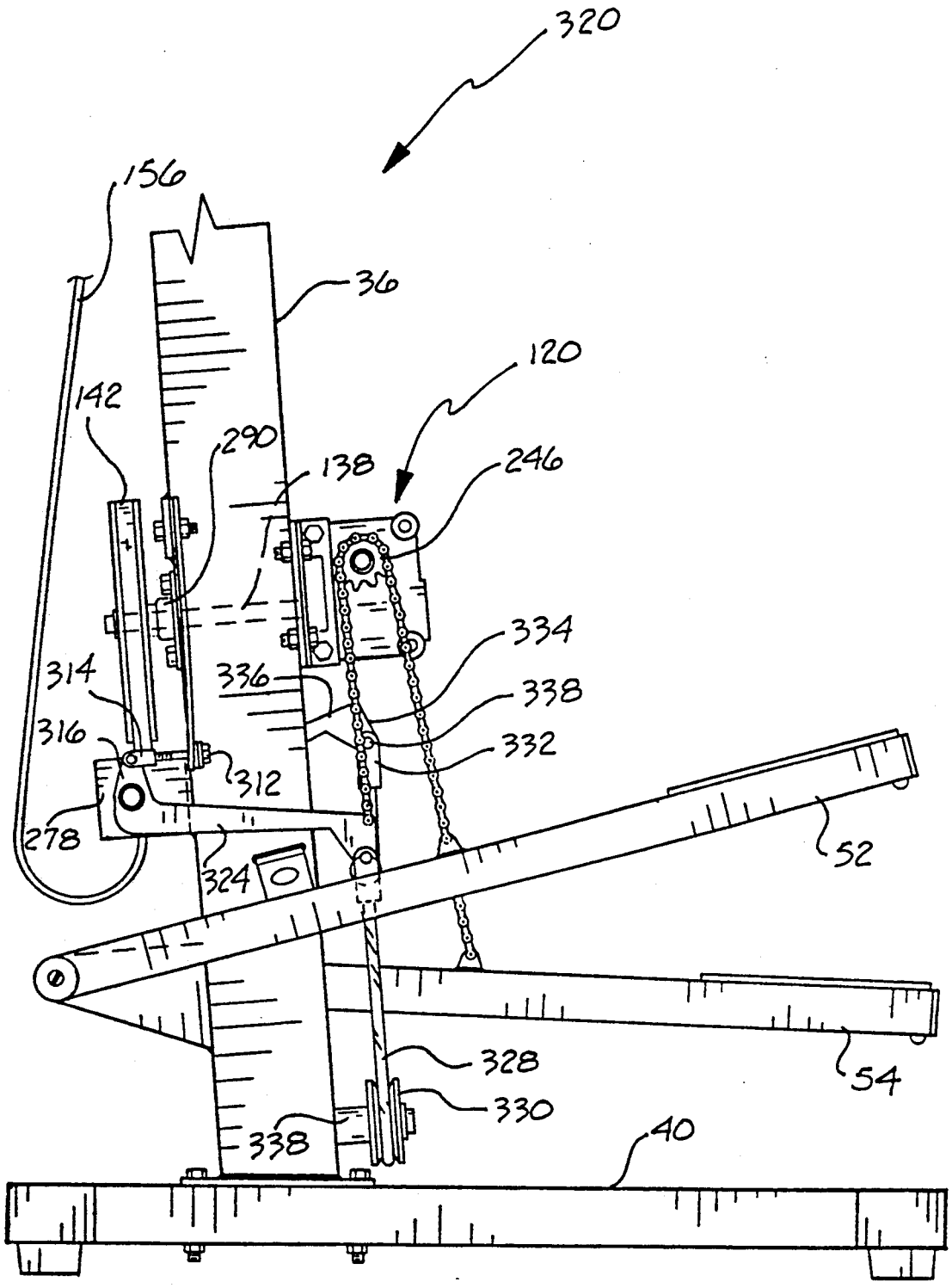
FIG. 22 is a left side elevational view of the lower half of a sixth embodiment of the exercise apparatus of this invention with synchronized foot levers which can be converted to independently operated foot levers.

In yet another embodiment of this invention shown in FIG. 22 and generally designated by numeral 320, the lower front distal end 322 of left cam 324 is connected to left end 326 of rope connector 328. Rope connector 328 is threaded down and around idler pulley 330 and connected at right rope connector end 332 to lower front distal end 334 of right cam 336. Idler pulley 330 is rotatably mounted on shaft 338 which is rigidly secured, as by welding, to upstanding member 36. With rope connector 328 installed the foot levers are synchronized. However by merely lifting up on both foot levers rope connector 328 is slackened and can be removed from idler pulley 330 thereby making the operation of the foot levers independent of each other. This embodiment therefore allows the user to conveniently convert from synchronized foot lever motion to independent foot lever motion.

Figure 23:
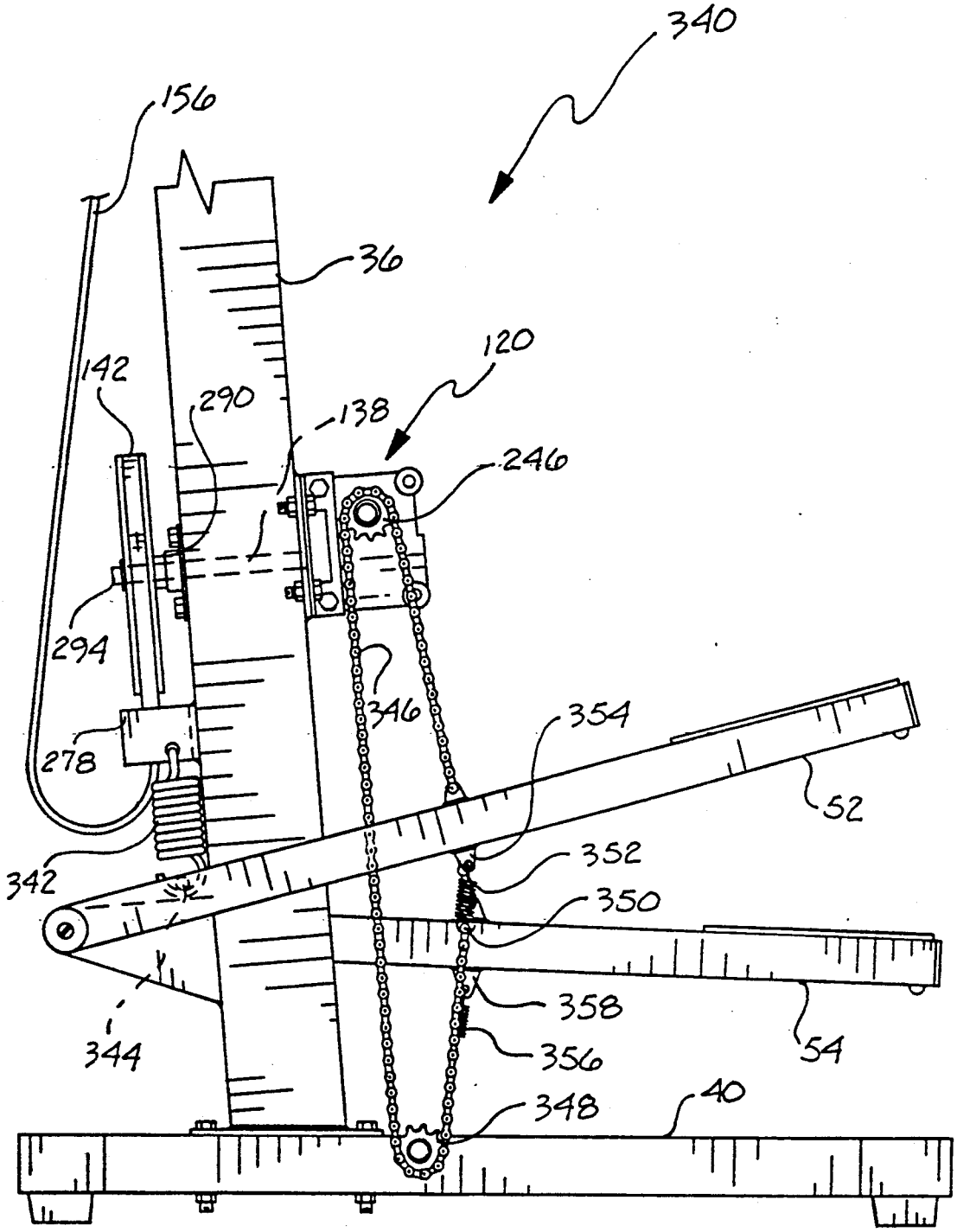
FIG. 23 is a left side elevational view of the lower half of a seventh embodiment of the exercise apparatus of this invention with independently operated foot levers.

In yet another embodiment of this invention shown in FIG. 23 and generally designated by numeral 340, the means for maintaining an upward bias comprises left and right extension springs connected, respectively, to the foot levers. As shown in FIG. 23, left extension spring 342 is connected to left foot lever 52 by pin 344 and bracket 278 thereby providing means for upward biasing the left foot lever. The right foot lever is also provided with a similar extension spring which is hidden from view in FIG. 23. Left chain 346 extends down and around idler sprocket 348 and is connected at distal end 350 to small extension spring 352 which is connected to bracket 354 which is rigidly secured, as by welding, to the lower side of left foot lever 52. Small extension spring 352 provides means for maintaining chain 246 in tension. The right chain is also extended down and around a similar idler sprocket (both of which are hidden from view in FIG. 23) and is connected at its distal end to small extension spring 356 which is connected to bracket 358 which is rigidly secured, as by welding, to the lower side of right foot lever 54. If desired small extension springs 352 and 356 can be omitted and the left and right chain connected directly to brackets 354 and 358, respectively, however, if springs 352 and 356 are omitted there will be a slight, but acceptable, amount of play in the chains due to the pivotal movement of the foot levers.

In these embodiment examples of suitable roller clutches 82 and 84 are Torrington Model No. RC-FCB-25 or INA Part No. HFL-2530, and an example of suitable worm gear system 120 is Morse Worm Gear Model 18 ED which has a 10 to 1 gear reduction ratio with slightly higher torque capacity than their Model 13 ED. Output worm 138 extends through upstanding member 36 and worm shaft bearing support 290 which is secured by bolts 292 to upstanding member 36. Flywheel 122 is mounted on the distal end 294 of worm shaft 138. Band brake 142 functions in the same manner as in the earlier described embodiments.

The embodiments of this invention preferably include handlebar 210 which is rigidly secured to upstanding member 36 by split clamps 212 and 214. Split clamp 212 is rigidly secured to upstanding member 36 by fasteners 216. Fasteners 218 draw split clamps 212 and 214 tightly against handlebar 210. Split clamp 214 is rigidly secured to plate 220 which is welded to the top of upstanding member 36. Plate 220 serves as a platform for mounting console 222. Console 222 preferably contains digital displays of user time, total steps, steps per minute, and, reset buttons therefor. In one embodiment console 222 is microprocessor controlled with liquid crystal display 224 including touch sensitive membrane switch controls such as start/stop button 226, mode button 228 and reset button 230. In another embodiment, console 222 also contains a jack for a pulse sensor and digital display of user's present pulse rate.

Handlebar 210 is preferably made from $\frac{7}{8}$ inch O. D., 0.065 inch wall thickness, stainless steel tubing covered with a friction, elastic material such as foam, vinyl or rubber. Similarly foot levers 52 and 54 preferably are fitted with high friction surfaces 232 and 234, respectively, made from an elastic material such as rubber and containing a ribbed upper surface to prevent the user from slipping off of the foot levers while exercising.

Preferably near each end of the under-surface of traverse members, 42 and 44 there is attached non-skid elastic mounts 236 for preventing movement of the exercise apparatus along its resting surface and damage thereto.

Preferably traverse members, 42 and 44 are made from 2 inch by 3 inch cold rolled electric welded ("CREW ") rectangular steel tubing having a wall thickness of about 0.062 to about 0.083 inches; however, thinner wall thickness can be used if desired. Preferably upstanding member 36 is made from 3 inch by 4 inch CREW rectangular steel tubing having a wall thickness of about 0.062 to about 0.083 inches; however thinner wall thickness can be used if desired. Preferably foot levers 52 and 54 are made from 1.5 inch by 3 inch CREW rectangular steel tubing having a wall thickness of about 0.095 to about 0.120 inches; however, thinner wall thickness can be used if desired. Preferably longitudinal members 40 are made from 1 inch by 2 inch rectangular steel tubing having a wall thickness of about 0.065 inches; however, thinner wall thickness can be used if desired.

Washers 101, 164 and 192 are preferably made of plastic such as Delrin TM brand plastics.

While the preferred embodiments of the present invention have been described, it should be understood that various changes, adaptations and modifications may be made thereto without departing from the spirit of the invention and the scope of the appended claims. It should be understood, therefore, that the invention is not to be limited to minor details of the illustrated invention shown in preferred embodiment and the figures and that variations in such minor details will be apparent to one skilled in the art.

Therefore it is to be understood that the present disclosure and embodiments of this invention described herein are for purposes of illustration and example and that modifications and improvements may be made thereto without departing from the spirit of the invention or from the scope of the claims. The claims, therefore, are to be accorded a range of equivalents commensurate in scope with the advances made over the art.

What is claimed is:

1. An exercise apparatus comprising:

a support structure;

a left foot lever pivotally connected to the support structure;

a right foot lever pivotally connected to the support structure;

a rotatable shaft rotatably attached to the support structure;

first clutch means drivingly connected to the rotatable shaft, the first clutch means for independently driving the rotatable shaft in a first-rotational direction when the first clutch means is rotated in the first-rotational direction and for overriding the rotatable shaft when the first clutch means is rotated in the counter first-rotational direction;

second clutch means drivingly connected to the rotatable shaft, the second clutch means for independently driving the rotatable shaft in the first-rotational direction when the second clutch means is rotated in the first-rotational direction and for overriding the rotatable shaft when the second clutch means is rotated in the counter first-rotational direction;

a first engaging member drivingly connected to the first clutch means;

a second engaging member drivingly connected to the second clutch means;

first flexible linking means for drivingly engaging the first engaging member, and for causing rotation of the first engaging member when the left foot lever is moved;

second flexible linking means for drivingly engaging the second engaging member, and for causing rotation of the second engaging member when the right foot lever is moved;

first biasing means for maintaining an upward bias on the left foot lever;

second biasing means for maintaining an upward bias on the right foot lever;

a worm gear mounted on the rotatable shaft;

a worm drivenly geared to the worm gear; and, resistance means for resisting the rotation of the worm.

2. The exercise apparatus of claim 1, further comprising first tensioning means for maintaining the first flexible linking means in tension; and second tensioning means for maintaining the second flexible linking means in tension.

3. The exercise apparatus of claim 1, wherein the first and second biasing means include torsion springs.

4. The exercise apparatus of claim 1, wherein the first and second biasing means include leaf springs.

5. The exercise apparatus of claim 1, wherein the first and second biasing means include springs.

6. The exercise apparatus of claim 2, wherein the first and second tensioning means include springs.

7. The exercise apparatus of claim 1, wherein the first engaging member and the second engaging member are sprockets, and wherein the first and second flexible linking means are chains.

8. The exercise apparatus of claim 1, wherein the resistance means includes a frictional brake.

9. The exercise apparatus of claim 1, wherein the resistance means includes an adjustable frictional brake.

10. The exercise apparatus of claim 1, further comprising a flywheel drivenly connected to the worm; and, wherein the resistance means includes means for resisting the rotation of the flywheel.

11. The exercise apparatus of claim 1, further comprising a flywheel drivenly connected to the worm; and, wherein the resistance means includes an adjustable band brake which surrounds the circumference of the flywheel.

12. The exercise apparatus of claim 1, wherein the support structure includes an upstanding member and a base, wherein the foot levers are pivotally connected to a buttress rigidly secured to the upstanding member, the rotatable shaft is rotatably attached to the upstanding member, and the resistance means is supported by the upstanding member.

13. An exercise apparatus comprising:

a support structure;

a left foot lever pivotally connected to the support structure;

a right foot lever pivotally connected to the support structure;

a rotatable shaft rotatably connected to the support structure, wherein the rotatable shaft is traversely oriented with respect to the foot levers;

left clutch means mounted on the rotatable shaft, the left clutch means for independently driving the rotatable shaft in a drive-rotational direction when the left clutch means is rotated in the drive-rotational direction and for overriding the rotatable shaft when the left clutch means is rotated in the counter drive-rotational direction;

right clutch means mounted on the rotatable shaft, the right clutch means for independently driving the rotatable shaft in the drive-rotational direction when the right clutch means is rotated in the drive-rotational direction and for overriding the rotatable shaft when the right clutch means is rotated in the counter drive-rotational direction;

a left engaging member drivingly connected to the left clutch means;

a right engaging member drivingly connected to the right clutch means;

left flexible linking means for drivingly engaging the left engaging member, and for causing rotation of the left engaging member when the left foot lever is moved;

right flexible linking means for drivingly engaging the right engaging member, and for causing rotation of the right engaging member when the right foot lever is moved;

left biasing means for maintaining an upward bias on the left foot lever;

right biasing means for maintaining an upward bias on the right foot lever;

a worm gear mounted on the rotatable shaft;

a worm drivenly geared to the worm gear; and, means for resisting the rotation of the worm.

14. An exercise apparatus comprising:

a support structure;

a left foot lever pivotally connected to the support structure;

a right foot lever pivotally connected to the support structure;

a rotatable shaft rotatably connected to the support structure, wherein the rotatable shaft is traversely oriented with respect to the foot levers;

left clutch means mounted on the rotatable shaft, the left clutch means for independently driving the rotatable shaft in a drive-rotational direction when the left clutch means is rotated in the drive-rotational direction and for overriding the rotatable shaft when the left clutch means is rotated in the counter drive-rotational direction;

right clutch means mounted on the rotatable shaft, the right clutch means for independently driving the rotatable shaft in the drive-rotational direction when the right clutch means is rotated in the drive-rotational direction and for overriding the rotatable shaft when the right clutch means is rotated in the counter drive-rotational direction;

a left sprocket mounted on the left clutch means;

a right sprocket mounted on the right clutch means;

left flexible chain linking means for drivingly engaging the left sprocket, and for causing rotation of the left sprocket when the left foot lever is moved;

right flexible chain linking means for drivingly engaging the right sprocket, and for causing rotation of the right sprocket when the right foot lever is moved;

left biasing means for maintaining an upward bias on the left foot lever;

right biasing means for maintaining an upward bias on the right foot lever;

a worm gear mounted on the rotatable shaft;

a worm drivenly geared to the worm gear; and, means for resisting the rotation of the worm.

15. An exercise apparatus comprising:

a support structure;

a left foot lever pivotally connected to the support structure;

a right foot lever pivotally connected to the support structure;

a rotatable shaft rotatably connected to the support structure, wherein the rotatable shaft is traversely oriented with respect to the foot levers;

left clutch means mounted on the rotatable shaft, the left clutch means for independently driving the rotatable shaft in a drive-rotational direction when the left clutch means is rotated in the drive-rotational direction and for overriding the rotatable shaft when the left clutch means is rotated in the counter drive-rotational direction;

right clutch means mounted on the rotatable shaft, the right clutch means for independently driving the rotatable shaft in the drive-rotational direction when the right clutch means is rotated in the drive-rotational direction and for overriding the rotatable shaft when the right clutch means is rotated in the counter drive-rotational direction;

a left sprocket mounted on the left clutch means;

a right sprocket mounted on the right clutch means;

left flexible chain linking means for drivingly engaging the left sprocket, and for causing rotation of the left sprocket when the left foot lever is moved;

right flexible chain linking means for drivingly engaging the right sprocket, and for causing rotation of the right sprocket when the right foot lever is moved;

left biasing means for maintaining an upward bias on the left foot lever;

right biasing means for maintaining an upward bias on the right foot lever; and, resistance means supported by the support structure, the resistance means including a worm gear mounted on the rotatable shaft, a worm drivenly geared to the worm gear, a flywheel mounted on the worm, and braking means for braking the flywheel.

16. An exercise apparatus comprising:

a support structure;

a left foot lever pivotally connected to the support structure;

a right foot lever pivotally connected to the support structure;

synchronization means for causing upward movement of one foot lever when the other foot lever is moved downward, the synchronization means comprising a rotatable shaft rotatably attached to the support structure, first clutch means drivingly connected to the rotatable shaft, the first clutch means for independently driving the rotatable shaft in a first-rotational direction when the first clutch means is rotated in the first-rotational direction and for overriding the rotatable shaft when the first clutch means is rotated in the counter first-rotational direction, second clutch means drivingly connected to the rotatable shaft, the second clutch means for independently driving the rotatable shaft in the first-rotational direction when the second clutch means is rotated in the first-rotational direction and for overriding the rotatable shaft when the second clutch means is rotated in the counter first-rotational direction, a first engaging member drivingly connected to the first clutch means, a second engaging member drivingly connected to the second clutch means, flexible linking means for providing a connection between the left foot lever and the right foot lever, for drivingly engaging the first engaging member and the second engaging member, and for causing rotation of the first engaging member and the second engaging member when the foot levers are moved; a worm gear mounted on the rotatable shaft; a worm drivenly geared to the worm gear; and, means for resisting the rotation of the worm.

17. The exercise apparatus of claim 16, wherein the first engaging member and the second engaging member are pulleys.

18. The exercise apparatus of claim 16, wherein the flexible linking means is a rope.

19. The exercise apparatus of claim 16, wherein the flexible linking means is a cable.

20. The exercise apparatus of claim 16, wherein the flexible linking means is a belt.

21. The exercise apparatus of claim 16, wherein the synchronization means includes reversal means attached to the support structure for reversing the direction of the flexible linking means.

22. An exercise apparatus comprising:

a support structure;

a left foot lever pivotally connected to the support structure;

a right foot lever pivotally connected to the support structure;

synchronization means for causing upward movement of one foot lever when the other foot lever is moved downward, the synchronization means comprising a rotatable shaft rotatably connected to the support structure, wherein the rotatable shaft is traversely oriented with respect to the foot levers, left clutch means mounted on the rotatable shaft, the left clutch means for independently driving the rotatable shaft in a drive-rotational direction when the left clutch means is rotated in the drive-rotational direction and for overriding the rotatable shaft when the left clutch means is rotated in the counter drive-rotational direction, right clutch means mounted on the rotatable shaft, the right clutch means for independently driving the rotatable shaft in the drive-rotational direction when the right clutch means is rotated in the drive-rotational direction and for overriding the rotatable shaft when the right clutch means is rotated in the counter drive-rotational direction, a left engaging member drivingly connected to the left clutch means, a right engaging member drivingly connected to the right clutch means, flexible linking means for providing a tension connection between the left foot lever and the right foot lever, for drivingly engaging the left engaging member and the right engaging member, and for causing rotation of the left engaging member and the right engaging member when the foot levers are moved; a worm gear mounted on the rotatable shaft; a worm drivenly geared to the worm gear; and, means for resisting the rotation of the worm.

23. An exercise apparatus comprising:

a support structure;

a left foot lever pivotally connected to the support structure;

a right foot lever pivotally connected to the support structure;

synchronization means for causing upward movement of one foot lever when the other foot lever is moved downward, the synchronization means comprising a rotatable shaft rotatably connected to the support structure, wherein the rotatable shaft is traversely oriented with respect to the foot levers, left clutch means mounted on the rotatable shaft, the left clutch means for independently driving the rotatable shaft in a drive-rotational direction when the left clutch means is rotated in the drive-rotational direction and for overriding the rotatable shaft when the left clutch means is rotated in the counter drive-rotational direction, right clutch means mounted on the rotatable shaft, the right clutch means for independently driving the rotatable shaft in the drive-rotational direction when the right clutch means is rotated in the drive-rotational direction and for overriding the rotatable shaft when the right clutch means is rotated in the counter drive-rotational direction, a left pulley mounted on the left clutch means, a right pulley mounted on the right clutch means, flexible line means for providing a tension connection between the left foot lever and the right foot lever, for drivingly engaging the left pulley and the right pulley, and for causing rotation of the left pulley and the right pulley when the foot levers are moved, reversal means rotatably attached to the support structure for reversing the direction of the flexible linking means;

a worm gear mounted on the rotatable shaft;

a worm drivenly geared to the worm gear; and, means for resisting the rotation of the worm.

24. An exercise apparatus comprising:

a support structure;

a left foot lever pivotally connected to the support structure;

a right foot lever pivotally connected to the support structure;

synchronization means for causing upward movement of one foot lever when the other foot lever is moved downward, the synchronization means comprising a rotatable shaft rotatably connected to the support structure, wherein the rotatable shaft is traversely oriented with respect to the foot levers, left clutch means mounted on the rotatable shaft, the left clutch means for independently driving the rotatable shaft in a drive-rotational direction when the left clutch means is rotated in the drive-rotational direction and for overriding the rotatable shaft when the left clutch means is rotated in the counter drive-rotational direction, right clutch means mounted on the rotatable shaft, the right clutch means for independently driving the rotatable shaft in the drive-rotational direction when the right clutch means is rotated in the drive-rotational direction and for overriding the rotatable shaft when the right clutch means is rotated in the counter drive-rotational direction, a left pulley mounted on the left clutch means, a right pulley mounted on the right clutch means, flexible line means for providing a tension connection between the left foot lever and the right foot lever, for drivingly engaging the left pulley and the right pulley, and for causing rotation of the left pulley and the right pulley when the foot levers are moved, reversal means rotatably attached to the support structure for reversing the direction of the flexible linking means; and, resistance means supported by the support structure, the resistance means including a worm gear mounted on the rotatable shaft, a worm drivenly geared to the worm gear, a flywheel mounted on the worm, and braking means for braking the flywheel.

* * * * *